US011302274B2

(12) United States Patent
Bae et al.

(10) Patent No.: US 11,302,274 B2
(45) Date of Patent: Apr. 12, 2022

(54) LIQUID CRYSTAL DISPLAY DEVICE

(71) Applicant: Samsung Display Co., Ltd., Yongin-Si (KR)

(72) Inventors: Jaesung Bae, Suwon-si (KR); Jungwon Kim, Seoul (KR); Gigeun Kim, Sejong-si (KR); Namgon Choi, Yongin-si (KR)

(73) Assignee: Samsung Display Co., Ltd.

( * ) Notice: Subject to any disclaimer, the term of this patent is extended or adjusted under 35 U.S.C. 154(b) by 0 days.

(21) Appl. No.: 16/794,080

(22) Filed: Feb. 18, 2020

(65) Prior Publication Data

US 2020/0184914 A1 Jun. 11, 2020

Related U.S. Application Data

(62) Division of application No. 15/987,680, filed on May 23, 2018, now abandoned.

(30) Foreign Application Priority Data

Jun. 7, 2017 (KR) ..... 10-2017-0070587

(51) Int. Cl.
*G09G 3/36* (2006.01)

(52) U.S. Cl.
CPC ..... *G09G 3/3614* (2013.01); *G09G 3/3607* (2013.01); *G09G 3/3688* (2013.01); (Continued)

(58) Field of Classification Search
CPC ... G09G 2300/0426; G09G 2300/0421; G09G 2300/0452; G09G 3/3614; G09G 3/3648; (Continued)

(56) References Cited

U.S. PATENT DOCUMENTS 9,418,398 B2 8/2016 Elliott et al.
9,489,911 B2 11/2016 Aoki et al.
(Continued)

FOREIGN PATENT DOCUMENTS

KR 10-2007-0019553 A 2/2007
KR 10-1326131 B1 11/2013
(Continued)

*Primary Examiner* — Koosha Sharifi-Tafreshi
(74) *Attorney, Agent, or Firm* — Innovation Counsel LLP

(57) ABSTRACT

A liquid crystal display device may include gate lines, data lines intersecting the gate lines, and pixels electrically connected to the gate lines and the data lines and arranged in pixel columns and pixel rows. The data lines include first-type data lines and second-type data lines. Exactly one pixel column is positioned between every immediately neighboring two of the first-type data lines. No pixel column is positioned between any immediately neighboring two of the second-type data lines. Each of the first-type data lines is electrically connected to a pixel of a first immediately adjacent pixel column in every odd-numbered pixel row and is connected to a pixel of a second immediately adjacent pixel column in every even-numbered pixel row. Each of the second-type data lines is electrically connected to a pixel of exactly one immediately adjacent pixel column in every other pixel row.

2 Claims, 17 Drawing Sheets

(52) U.S. Cl.
CPC ..... *G09G 2300/0426* (2013.01); *G09G 2300/0443* (2013.01); *G09G 2300/0452* (2013.01); *G09G 2300/08* (2013.01); *G09G 2320/0242* (2013.01)

(58) Field of Classification Search
CPC .. G09G 3/2003; G09G 3/3607; G09G 3/3688; G02F 1/133707; G02F 1/134309; G02F 1/1343; G02F 2201/123; G02F 2201/52
See application file for complete search history.

(56) References Cited

U.S. PATENT DOCUMENTS

| | | | | |
|---|---|---|---|---|
| 9,620,533 | B2 | 4/2017 | Kim et al. | |
| 10,354,604 | B2 | 7/2019 | Kim et al. | |
| 2004/0114046 | A1* | 6/2004 | Lee | H04N 9/67 348/279 |
| 2007/0035687 | A1 | 2/2007 | Oke et al. | |
| 2010/0007809 | A1 | 1/2010 | You et al. | |
| 2010/0053526 | A1 | 3/2010 | Kye et al. | |
| 2010/0053528 | A1 | 3/2010 | Li et al. | |
| 2011/0241979 | A1* | 10/2011 | Baek | G09G 3/3614 345/88 |
| 2012/0139970 | A1 | 6/2012 | Kim | |
| 2012/0218248 | A1 | 8/2012 | Tsubata | |
| 2015/0379950 | A1* | 12/2015 | Sun | G09G 3/3614 345/87 |
| 2016/0232829 | A1 | 8/2016 | Ahn et al. | |
| 2016/0232862 | A1 | 8/2016 | Kim et al. | |

FOREIGN PATENT DOCUMENTS

| | | | |
|---|---|---|---|
| KR | 10-1330393 | B1 | 11/2013 |
| KR | 10-2015-0073491 | A | 7/2015 |
| KR | 10-2016-0072368 | A | 6/2016 |
| KR | 10-2016-0084553 | A | 7/2016 |
| KR | 10-2016-0097444 | A | 8/2016 |
| KR | 2016-0096778 | A | 8/2016 |

* cited by examiner

LIQUID CRYSTAL DISPLAY DEVICE

CROSS-REFERENCE TO RELATED APPLICATION(S)

This application is a divisional application of U.S. patent application Ser. No. 15/987,680 filed May 23, 2018, which claims priority to and the benefit of Korean Patent Application No. 10-2017-0070587, filed on Jun. 7, 2017, in the Korean Intellectual Property Office, the disclosure of which is incorporated herein in its entirety by reference.

BACKGROUND

1. Field

The technical field relates to a liquid crystal display (LCD) device.

2. Description of the Related Art

Modern display devices include liquid crystal display (LCD) devices, organic light emitting diode (OLED) display devices, plasma display panel (PDP) devices, and electrophoretic display (EPD) device.

An LCD device typically includes a pixel electrode, a common electrode, and a liquid crystal layer. When a voltage is applied to the pixel electrode and the common electrode, liquid crystal molecules of the liquid crystal layer are rearranged to control transmission of light.

This background section is intended to provide useful background for facilitating understanding of the technology. The background section may include information that is not known or appreciated by those skilled in the pertinent art prior to a corresponding effective filing date of this application.

SUMMARY

Embodiments may be directed to a liquid crystal display (LCD) device which may prevent a moving line stain phenomenon.

According to an embodiment, a liquid crystal display device includes: a plurality of gate lines extending in a first direction; a plurality of data lines extending in a second direction which intersects the first direction; and a plurality of pixels connected to the gate lines and the data lines. The plurality of pixels are each located between adjacent two of the data lines, and form first to fourth pixel columns having different colors. The data lines include first data lines each arranged between adjacent two of the pixel columns in a single arrangement form, and second data lines arranged between some adjacent two of the pixel columns in a double arrangement form. Each of the first data lines is connected to alternate pixels of the adjacent two of the pixel columns in every other row. Each of the second data lines is connected to alternate pixels of an adjacent one of the pixel columns in every other row.

The first to fourth pixel columns may be repeatedly arranged in the first direction.

Each of the first to fourth pixel columns may be any one of a red pixel column, a green pixel column, a blue pixel column, and a white pixel column.

Pixels included in each of the first to fourth pixel columns may have an identical color.

Polarities of data voltages which are applied to each two of the data lines arranged adjacent to each other in the first direction may be opposite.

The pixels may not be arranged between each pair of the second data lines.

The each pair of the second data lines may be arranged between the fourth and first pixel columns.

A spacing distance between the fourth and first pixel columns may be larger than a spacing distance between the first and second pixel columns, a spacing distance between the second and third pixel columns, and a spacing distance between the third and fourth pixel columns.

The each pair of the second data lines may be arranged between the first and second pixel columns.

A spacing distance between the first and second pixel columns may be larger than a spacing between the second and third pixel columns, a spacing distance between the third and fourth pixel columns, and a spacing distance between the fourth and first pixel columns.

The each pair of the second data lines may be arranged between the second and third pixel columns.

A spacing distance between the second and third pixel columns may be larger than a spacing the first and second pixel columns, a spacing distance between the third and fourth pixel columns, and a spacing distance between the fourth and first pixel columns.

The each pair of the second data lines may be arranged between the third and fourth pixel columns.

A spacing distance between the third and fourth pixel columns may be larger than a spacing the first and second pixel columns, a spacing distance between the second and third pixel columns, and a spacing distance between the fourth and first pixel columns.

According to an embodiment, a liquid crystal display device includes: a plurality of gate lines extending in a first direction; a plurality of data lines extending in a second direction which intersects the first direction; and a plurality of pixels connected to the gate lines and the data lines. The data lines include first data lines each arranged between two adjacent pixel columns in a single arrangement form, and second data lines arranged between some two adjacent pixel columns in a double arrangement form. Each of the second data lines is connected to alternate pixels of one adjacent pixel column in every other row. The liquid crystal display device further includes dummy thin film transistors each connected to one of the second data lines.

Each of the dummy thin film transistors may include: a dummy gate electrode branched off from a corresponding one of the gate lines; a dummy semiconductor layer arranged to be insulated from and overlap the dummy gate electrode; and a dummy source electrode branched off from the data line.

Each of the dummy thin film transistors may further include a dummy drain electrode arranged to be spaced apart from the dummy source electrode.

Each of the pixels may include a pixel electrode, and the dummy drain electrode may not be connected to the pixel electrode.

The plurality of pixels may be each located between adjacent two of the data lines, and may form first to fourth pixel columns having different colors.

Each of the first data lines may be connected to alternate pixels of each adjacent pixel column in every other row.

According to an embodiment, a liquid crystal display device including: a plurality of gate lines extending in a first direction; a plurality of data lines extending in a second direction which intersects the first direction; and a plurality of pixels connected to the gate lines and the data lines. The plurality of pixels may be each located between adjacent two of the data lines, and may form first to fourth pixel columns having different colors. Adjacent two of the data lines may be arranged between some adjacent two of the first to fourth pixel columns.

Each adjacent two of pixels included in each of the first to fourth pixel columns may be connected to different two of the data lines.

The first to fourth pixel columns may be repeatedly arranged in the first direction.

Each of the first to fourth pixel columns may be any one of a red pixel column, a green pixel column, a blue pixel column, and a white pixel column.

Pixels included in each of the first to fourth pixel columns may have an identical color.

Polarities of data voltages which are applied to each two of the data lines arranged adjacent to each other in the first direction may be opposite.

Each of the two data lines may be connected to alternate pixels of an adjacent one of the first to fourth pixel columns in every other row.

The pixels may not be arranged between the two data lines.

An embodiment may be related to a liquid crystal display device. The liquid crystal display device may include a plurality of gate lines extending in a first direction, a plurality of data lines extending in a second direction which is different from the first direction, and a plurality of pixels electrically connected to the gate lines and the data lines. The pixels may be arranged in pixel columns and pixel rows. Each pixel column of the pixel columns may be located between immediately adjacent two of the data lines. Consecutively arranged four of the pixel columns may be configured to display four different colors, respectively. The data lines may include first-type data lines and second-type data lines. Exactly one pixel column of the pixel columns may be positioned between every immediately neighboring two of the first-type data lines. No pixel column may be positioned between any immediately neighboring two of the second-type data lines. Each of the first-type data lines may be electrically connected to a pixel of a first immediately adjacent pixel column in every odd-numbered pixel row and may be electrically connected to a pixel of a second immediately adjacent pixel column in every even-numbered pixel row. Each of the second-type data lines may be electrically connected to a pixel of exactly one immediately adjacent pixel column in every other pixel row.

The pixel columns may be grouped into pixel groups. The pixel groups may be arranged in the first direction. Each pixel group of the pixel groups may include four pixel columns arranged in the first direction and configured to display the four different colors, respectively.

The Consecutively arranged four of the pixel columns may be a red pixel column, a green pixel column, a blue pixel column, and a white pixel column, respectively.

Pixels included in a same pixel column of the pixel columns have an identical color.

Polarities of data voltages applied to every immediate neighboring two of the data lines may be opposite.

No pixels may be arranged between any immediately neighboring pair of the second-type data lines.

The pixel columns may be grouped into pixel groups. Each pixel group of the pixel groups may include four pixel columns arranged in the first direction and configured to display the four different colors, respectively. The each immediately neighboring pair of the second-type data lines may be arranged between two immediately neighboring pixel groups of the pixel groups.

A distance between the two immediately neighboring pixel groups may be larger than a distance between every two immediately neighboring pixel columns in each of the two immediately neighboring pixel groups.

Each immediately neighboring pair of the second-type data lines may be arranged between a first-color pixel column and a second-color pixel column that immediately neighbor each other and may be configured to respectively display a first color and a second color different from each other.

A distance between an immediately neighboring pair of a first-color pixel column and a second-color pixel column may be larger than each of a distance between an immediately neighboring pair of a second-color pixel column and third-color pixel column, a distance between an immediately neighboring pair of a third-color pixel column and a fourth-color pixel column, and a distance between an immediately neighboring pair of a fourth-color pixel column and a first-color pixel column.

Each immediately neighboring pair of the second-type data lines may be arranged between a green pixel column and a blue pixel column that immediately neighbor each other.

A distance between an immediately neighboring pair of a green pixel column and a blue pixel column may be larger than each of a distance between an immediately neighboring pair of a red pixel column and a green pixel column, a distance between an immediately pair of a blue pixel column and a white pixel column, and a distance between an immediately neighboring pair of a white pixel column and a red pixel column.

Each immediately neighboring pair of the second data lines may be arranged between a blue pixel column and a white pixel column that immediately neighbor each other.

A distance between an immediately neighboring pair of a blue pixel column and a white pixel column may be larger than each of a distance between an immediately neighboring pair of a red pixel column and a green pixel columns, a distance between an immediately neighboring pair of a green pixel column and a blue pixel column, and a distance between an immediately neighboring pair of a white pixel column and a white pixel column.

An embodiment may be related to a liquid crystal display device. The liquid crystal display device may include a plurality of gate lines extending in a first direction, a plurality of data lines extending in a second direction different from the first direction, a plurality of pixels electrically connected to the gate lines and the data lines, and a plurality of dummy thin-film transistors. The pixels may be arranged in pixel columns and pixel rows. The data lines may include first-type data lines and second-type data lines. Exactly one pixel column of the pixel columns may be positioned between every immediately neighboring two of the first-type data lines. No pixel column may be positioned between any immediately neighboring two of the second-type data lines. Each of the second-type data lines may be electrically connected to a pixel of exactly one immediately adjacent pixel column in every other pixel row. Each of the dummy thin film transistors may be electrically connected to one of the second-type data lines.

Each of the dummy thin film transistors may include a dummy gate electrode branched from a corresponding one of the gate lines, a dummy semiconductor layer insulated from and overlapping the dummy gate electrode, and a dummy source electrode branched from the one of the second-type data lines.

Each of the dummy thin film transistors may include a dummy drain electrode spaced from the dummy source electrode.

Each of the pixels may include a pixel electrode. Each of the dummy drain electrodes may not be electrically connected to any pixel electrode of any of the pixels.

The pixels each may be located between immediately adjacent two of the data lines. The pixel columns may include a plurality of first-color pixel columns, a plurality of second-color pixel columns, a plurality of third-color pixel columns, and a plurality of fourth-color pixel columns having four different colors, respectively.

Each of the first-type data lines may be electrically connected to a pixel of a first immediately adjacent pixel column in every odd-numbered pixel row and may be electrically connected to a pixel of a second immediately adjacent pixel column in every even-numbered pixel row.

An embodiment may be related to a liquid crystal display device. The liquid crystal display device may include a plurality of gate lines extending in a first direction, a plurality of data lines extending in a second direction different from the first direction, and a plurality of pixels electrically connected to the gate lines and the data lines. The pixels may be arranged in pixel columns and pixel rows. Each pixel column of the pixel columns may be located between immediately adjacent two of the data lines. The pixel columns may include a first-color pixel column, a second-color pixel column, a third-color pixel column, and a fourth-color pixel column having four different colors, respectively. Two immediately neighboring data lines of the data lines may be arranged between immediately adjacent two of the first-color pixel column, the second-color pixel column, the third-color pixel column, and the fourth-color pixel column.

Each immediately adjacent two of pixels included in each of the pixel columns may be electrically connected to different two of the data lines.

The pixel columns may be grouped into pixel groups. Each pixel group of the pixel groups may include four pixel columns consecutively arranged in the first direction and configured to respectively display the four different colors.

The first-color pixel column, the second-color pixel column, the third-color pixel column, and the fourth pixel column may be a red pixel column, a green pixel column, a blue pixel column, and a white pixel column, respectively.

Pixels included in a same pixel column of the pixel columns have an identical color.

Polarities of data voltages applied to the two immediately neighboring data lines of the data lines may be opposite.

Each of the two immediately neighboring data lines of the data lines may be electrically connected to a pixel of exactly one immediately adjacent pixel column in every other pixel row.

No pixels may be arranged between the two immediately neighboring data lines of the data lines.

DETAILED DESCRIPTION

Figure 1:
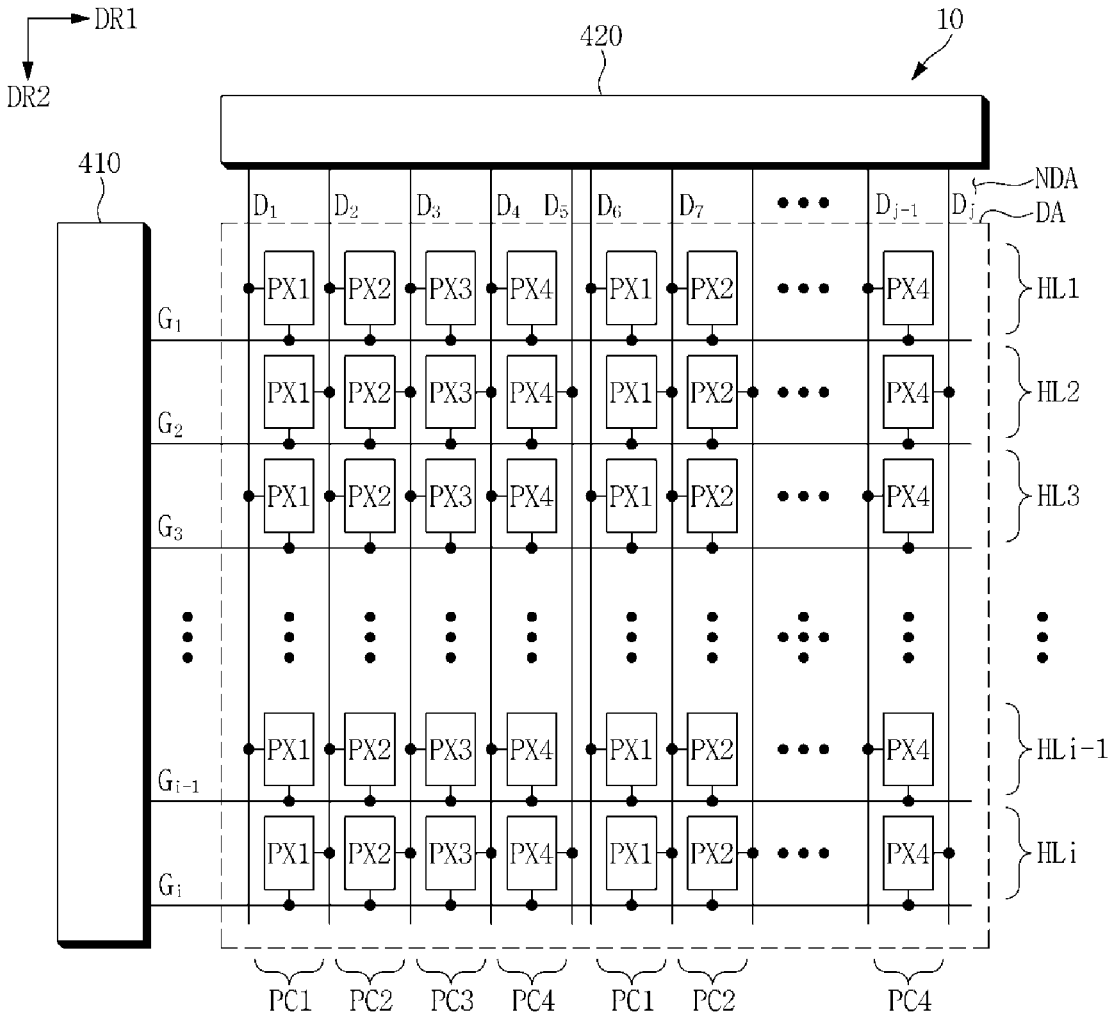
FIG. 1 is a schematic block diagram illustrating a liquid crystal display ("LCD") device according to an embodiment.

Example embodiments are described with reference to the accompanying drawings. Practical embodiments may be implemented in many different forms and should not be construed as being limited to the described embodiments.

Like reference numerals may refer to like elements.

Although the terms "first," "second," etc. may be used herein to describe various elements, these elements, should not be limited by these terms. These terms may be used to distinguish one element from another element. Thus, a first element may be termed a second element without departing from teachings of one or more embodiments. The description of an element as a "first" element may not require or imply the presence of a second element or other elements. The terms "first," "second," etc. may also be used herein to differentiate different categories or sets of elements. For conciseness, the term "first" may represent, for example, "first-type," "first-set," or "first-color"; the term "second" may represent, for example, "second-type," "second-set," or "second-color"; the term "third" may represent, for example, "third-color"; the term "fourth" may represent "fourth-color."

In the drawings, thicknesses of a plurality of layers and areas may be illustrated in an enlarged manner for clarity and ease of description.

When a first element is referred to as being "on" a second element, the first element may be directly on the second element, or one or more intervening element may be present between the first element and the second element. When a first element is referred to as being "directly on" a second element, no intervening layers, except environmental elements such as air, may be present between the first element and the second element.

The spatially relative terms "below," "beneath," "lower," "above," "upper," and the like, may be used to describe the relations between one element or component and another element or component as illustrated in the drawings. The spatially relative terms are intended to encompass different orientations of the device in use or operation, in addition to the orientation depicted in the drawings. For example, in the case where a device shown in the drawing is turned over, a first element positioned "below" or "beneath" a second element may be placed "above" second element. Accordingly, the illustrative term "below" may include both the lower and upper positions. The device may also be oriented in other orientations, and thus the spatially relative terms may be interpreted differently depending on the orientations.

When a first element is referred to as being "connected" to a second element, the first element may be "directly connected" to the second element or may be "electrically connected" to the second element through one or more intervening elements.

The terms "comprises," "comprising," "includes" and/or "including," when used in this specification, specify the presence of stated features, integers, steps, operations, elements, and/or components, but may not preclude the presence or addition of one or more other features, integers, steps, operations, elements, components, and/or groups thereof.

"About" or "approximately" as used herein is inclusive of the stated value and means within an acceptable range of deviation for the particular value as determined by one of ordinary skill in the art, considering the measurement in question and the error associated with measurement of the particular quantity (i.e., the limitations of the measurement system). For example, "about" can mean within one or more standard deviations, or within ±30%, 20%, 10%, or 5% of the stated value.

Unless otherwise defined, all terms used herein (including technical and scientific terms) have the same meaning as commonly understood by those skilled in the art to which this invention pertains. Terms, such as those defined in commonly used dictionaries, should be interpreted as having a meaning that is consistent with their meaning in the context of the relevant art and will not be interpreted in an ideal or excessively formal sense unless clearly defined in the present specification.

The term "adjacent" may mean "immediately neighboring with no intervening similar element."

FIG. 1 is a schematic block diagram illustrating a liquid crystal display ("LCD") device according to a first embodiment.

Referring to FIG. 1, the LCD device according to the first embodiment may include the following elements: a display panel 10 including a display area DA, and a non-display area NDA arranged adjacent to the display area DA; and a gate driver 410 and a data driver 420 arranged in the non-display area NDA of the display panel 10.

The display panel 10 may include a plurality of gate lines $G_1$ to $G_i$ extending in a first direction DR1, a plurality of data lines $D_1$ to $D_j$ extending in a second direction DR2 which intersects the first direction DR1, and a plurality of pixels PX1, PX2, PX3, and PX4 connected to the gate lines $G_1$ to $G_i$ and the data lines $D_1$ to $D_j$.

The gate lines $G_1$ to $G_i$ extend up to the non-display area NDA and are connected to the gate driver 410, and the data lines $D_1$ to $D_j$ extend up to the non-display area NDA and are connected to the data driver 420.

The gate driver 410 generates gate signals in response to a gate control signal applied from a timing controller (not shown), and sequentially applies the gate signals to the gate lines $G_1$ to $G_i$. The data driver 420 receives digital image data signals and a data control signal from a timing controller (not shown), and applies the signals to the data lines $D_1$ to $D_j$.

The pixels PX1, PX2, PX3, and PX4 are located in the display area DA of the display panel 10.

The pixels PX1, PX2, PX3, and PX4 are areas defined by the gate lines and the data lines, and refer to minimum elements in display of an image. In an embodiment, the pixels PX1, PX2, PX3, and PX4 may be defined by a black matrix.

A plurality of adjacent pixels PX1, PX2, PX3, and PX4 may form a single unit pixel. For example, the plurality of pixels PX1, PX2, PX3, and PX4 forming the single unit pixel may be connected to the same gate line, and may be connected to different data lines.

Figure 2:
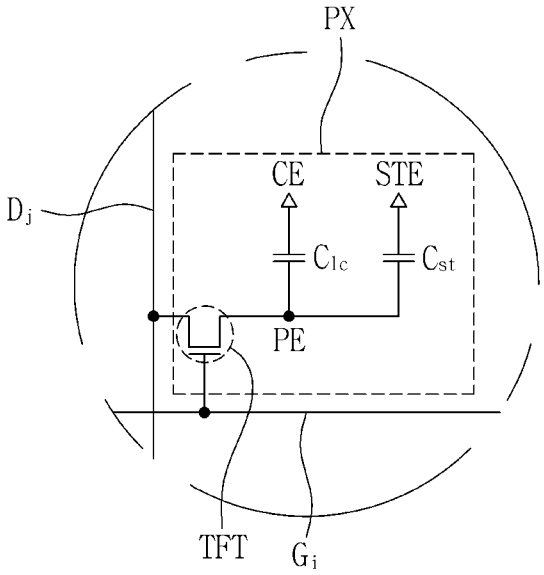
FIG. 2 is an equivalent circuit diagram illustrating one pixel shown in FIG. 1 according to an embodiment.

FIG. 2 is an equivalent circuit diagram illustrating one pixel shown in FIG. 1.

Referring to FIG. 2, each pixel PX may include a thin film transistor TFT, a pixel electrode PE, a common electrode CE, and a storage electrode STE. The thin film transistor TFT is turned on in response to a signal applied from a gate line $G_i$. The turned-on thin film transistor TFT transfers an analog image data signal, applied from a data line $D_j$, to the pixel electrode PE. A liquid crystal storage capacitor $C_{lc}$ may be disposed between the pixel electrode PE and the common electrode CE located opposite to each other, and an extra storage capacitor $C_{st}$ may be disposed between the pixel electrode PE and the storage electrode STE located opposite to each other.

Figure 3:
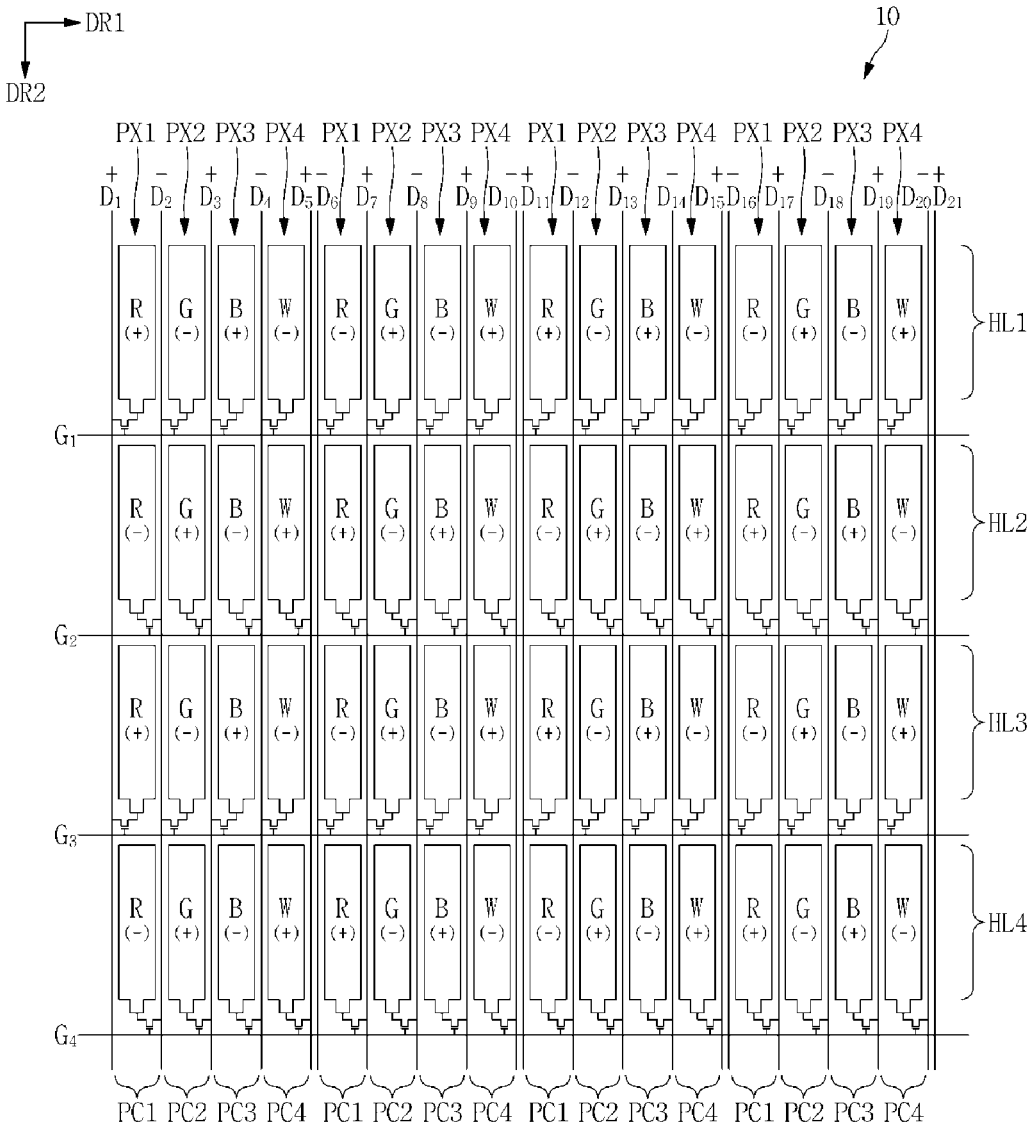
FIG. 3 is a plan view illustrating a display panel according to an embodiment.

FIG. 3 is a plan view illustrating a display panel 10 according to a first embodiment.

Referring to FIGS. 1 and 3, the display panel 10 according to the first embodiment may include a first pixel PX1, a second pixel PX2, a third pixel PX3, and a fourth pixel PX4. The first to fourth pixels PX1 to PX4 may display different colors. For example, each of the first to fourth pixels PX1 to PX4 may be any one of a red pixel, a green pixel, a blue pixel, and a white pixel.

Although for ease of description, the following description will be given on the assumption that the first pixel PX1 is a red pixel R, the second pixel PX2 is a green pixel G, the third pixel PX3 is a blue pixel B, and the fourth pixel PX4 is a white pixel W, the types/colors of first to fourth pixels PX1 to PX4 are not limited thereto.

First to fourth pixels PX1 to PX4 may be repeatedly arranged in a first direction DR1, and each of the first to fourth pixels PX1 to PX4 may be repeatedly arranged in a second direction DR2 which intersects the first direction DR1. In other words, pixels which display the same color may be arranged in the second direction DR2.

Pixels which display the same color and which are also arranged in the second direction DR2 are collectively referred to as a "pixel column." In other words, a plurality of first(-color) pixels PX1 arranged in the second direction DR2 are referred to as a "first(-color) pixel column PC1," a plurality of second(-color) pixels PX2 arranged in the second direction DR2 are referred to as a "second(-color) pixel column PC2," a plurality of third(-color) pixels PX3 arranged in the second direction DR2 are referred to as a "third(-color) pixel column PC3," and a plurality of fourth (-color) pixels PX4 arranged in the second direction DR2 are referred to as a "fourth(-color) pixel column PC4."

First to fourth pixel columns PC1 to PC4 may be repeatedly arranged in the first direction DR1.

Furthermore, j pixels connected to a single gate line $G_n$ (where n is any one of 1 to i) is collectively referred to as a "pixel row." In other words, j pixels connected to a first gate line $G_1$ are referred to as a "first pixel row HL1," and j pixels connected to a second gate line $G_2$ are referred to as a "second pixel row HL2."

Pixels arranged in odd-numbered pixel rows HL1, HL3 . . . , and HLi−1 may be connected to a left one of data lines arranged on both sides of the display panel 10, and pixels arranged in even-numbered pixel rows HL2 . . . , and HLi may be connected to a right one of the data lines arranged on both sides of the display panel 10.

Conversely, the pixels arranged in the odd-numbered pixel rows HL1, HL3 . . . , and HLi−1 may be connected to the right one of the data lines arranged on both sides of the display panel 10, and the pixels arranged in the even-numbered pixel rows HL2 . . . , and HLi may be connected to the left one of the data lines arranged on both sides of the display panel 10.

As described above, each adjacent two of pixels in the second direction DR2 may be connected to different data lines. In other words, each two of the pixels included in the first pixel column PC1 may be connected to different data lines. This is the same for the second to fourth pixel columns PC2 to PC4.

Data lines $D_1$ to $D_j$ according to the present embodiment may be arranged between the pixel columns PC1, PC2, PC3, and PC4. The data lines $D_1$ to $D_j$ may be arranged between the pixel columns PC1, PC2, PC3, and PC4 in a single or double arrangement form.

Data lines $D_1$ to $D_j$ which are arranged between the pixel columns PC1, PC2, PC3, and PC4 in a single arrangement are referred to "first(-type) data lines," and data lines $D_1$ to $D_j$ which are arranged between the pixel columns PC1, PC2, PC3, and PC4 in a double arrangement form are referred to "second(-type) data lines."

In the case of the first embodiment, the second data lines $D_5$, $D_6$, $D_{10}$, $D_{11}$, $D_{15}$, $D_{16}$, $D_{20}$, $D_{21}$, . . . may be arranged between the fourth and first pixel columns PC4 and PC1 arranged adjacent to each other, and the first data lines $D_1$ to $D_4$, $D_7$ to $D_9$, $D_{12}$ to $D_{14}$, and $D_{17}$ to $D_{19}$ may be arranged between the first, and second pixel columns PC1, and PC2, between the second and third pixel columns PC2 and PC3, or between the third and fourth pixel columns PC3 and PC4.

Each of the second data lines $D_5$, $D_6$, $D_{10}$, $D_{11}$, $D_{15}$, $D_{16}$, $D_{20}$, $D_{21}$, . . . arranged between the fourth and first pixel columns PC4 and PC1 may be connected to a pixel of a pixel column on its one side in every other row. For example, the data line $D_5$ may be connected to a pixel of the adjacent fourth pixel column PC4 in every other row, and the data line $D_6$ may be connected to a pixel of the adjacent first pixel column PC1 in every other row.

Furthermore, polarities of data voltages which are applied to each adjacent two of the data lines $D_1$ to $D_j$ in the first direction DR1 may be opposite. For example, when a polarity of data voltages which are applied to the odd-numbered data lines $D_1$, $D_3$, $D_5$, . . . is positive (+), a polarity of data voltages which are applied to the even-numbered data lines $D_2$, $D_4$, $D_6$, . . . may be negative (−). In the same manner, when a polarity of data voltages which are applied to the odd-numbered data lines $D_1$, $D_3$, $D_5$, . . . is negative (−), a polarity of data voltages which are applied to the even-numbered data lines $D_2$, $D_4$, $D_6$, . . . may be positive (+). Furthermore, polarities of data voltages which are applied to the data lines $D_1$ to $D_j$ may be inverted every frame period.

As described above, two data lines are arranged between the fourth pixel column PC4 and the first pixel column PC1, and a pixel of each of the pixel columns PC4 and PC1 in every other row are connected to one of the two data lines. Accordingly, data voltages of different polarities may be applied to pixels arranged adjacent to each other in each of the fourth and first pixel columns PC4 and PC1.

As a result, a moving line stain phenomenon which occurs when data voltages of the same polarity are applied to pixels arranged in one pixel column may be prevented from occurring. When the fourth pixel column PC4 is a white pixel column, a moving line stain phenomenon which may occur in a white pixel column may be prevented from occurring.

Figure 4:
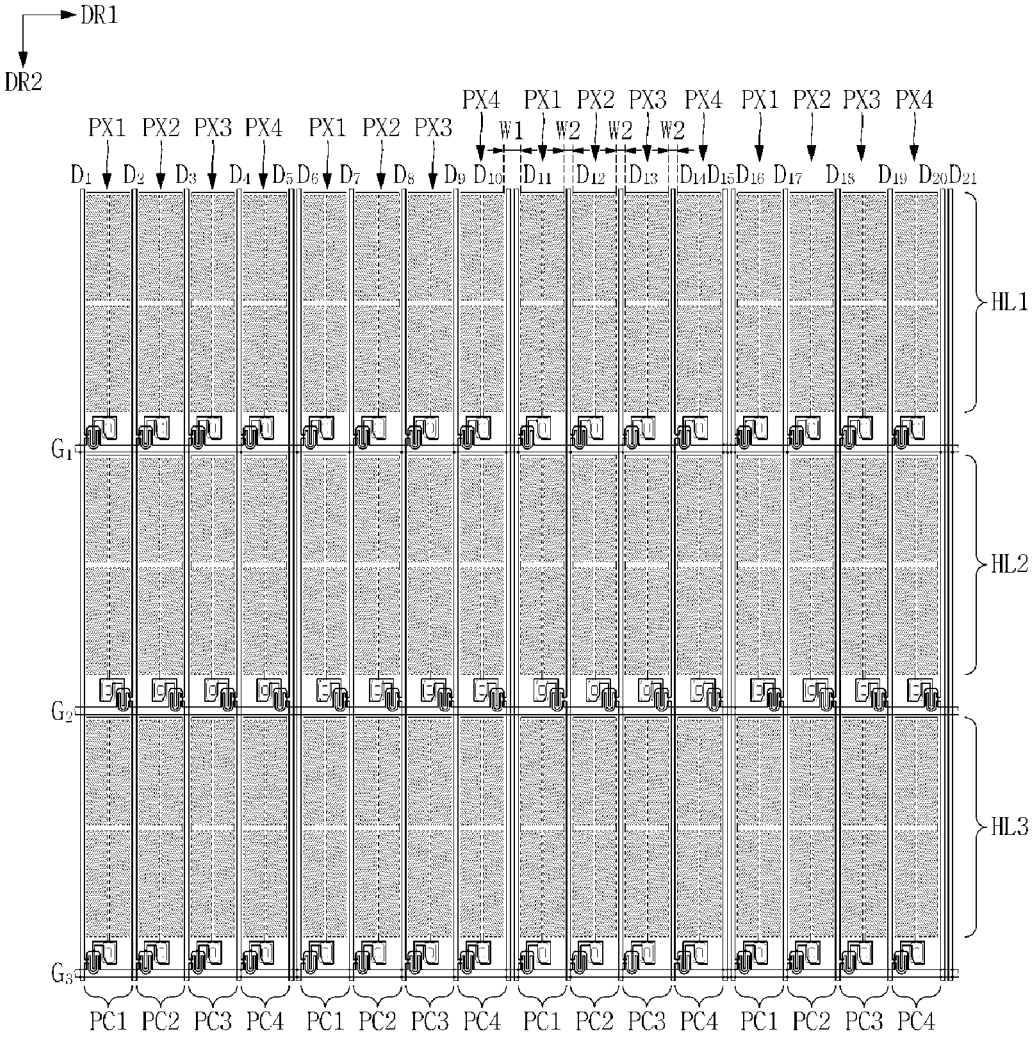
FIG. 4 is a plan view illustrating a display panel according to an embodiment.
Figure 5:
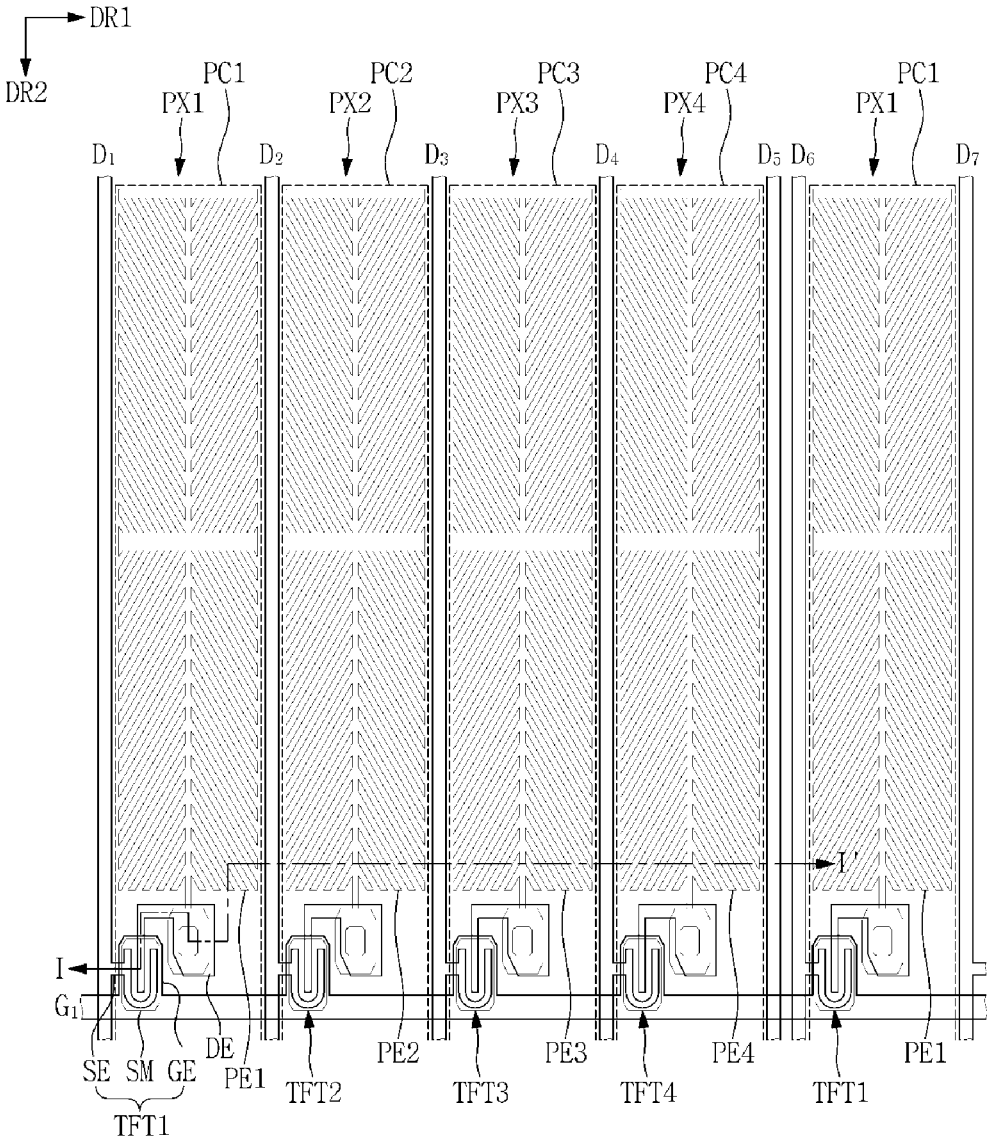
FIG. 5 is a partially enlarged view illustrating a portion of FIG. 4 according to an embodiment.
Figure 6:
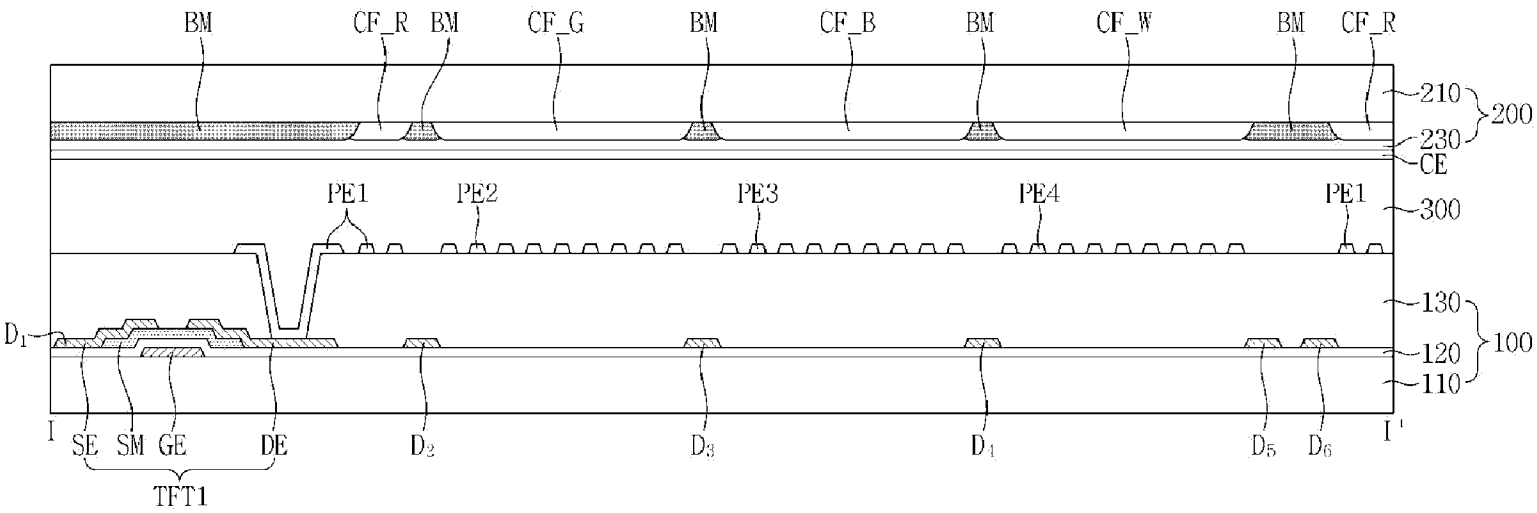
FIG. 6 is a sectional view taken along line I-I' of FIG. 5 according to an embodiment.

FIG. 4 is a plan view illustrating the display panel 10 according to the first embodiment, FIG. 5 is a partially enlarged view illustrating a portion of FIG. 4, and FIG. 6 is a cross-sectional view taken along line I-I' of FIG. 5.

Referring to FIGS. 4 to 6, the display panel 10 according to the first embodiment may include a display substrate 100, a counter substrate 200, and a liquid crystal layer 300 disposed between the display substrate 100 and the counter substrate 200.

The display substrate 100 may include: a first substrate 110 including a first pixel PX1, a second pixel PX2, a third pixel PX3, and a fourth pixel PX4 which display different colors; gate lines $G_1$ to $G_3$ arranged on the first substrate 110, and extending in a first direction DR1; data lines $D_1$ to $D_4$ arranged on the first substrate 110, and extending in a second direction DR2 which intersects the first direction DR1; first to fourth thin film transistors TFT1, TFT2, TFT3, and TFT4 connected to the gate lines $G_1$ to $G_3$ and the data lines $D_1$ to $D_{21}$; first to fourth pixel electrodes PE1, PE2, PE3, and PE4 connected to the first to fourth thin film transistors TFT1, TFT2, TFT3, and TFT4, respectively; a gate insulating film 120; and a protective film 130.

The following description will be given on the assumption that the first pixel PX1 displays a red color, the second pixel PX2 displays a green color, the third pixel PX3 displays a blue color, and the fourth pixel PX4 displays a white color.

The first substrate 110 is made of transparent glass or plastic, or the like.

Gate wiring, including the gate lines $G_1$ to $G_3$ extending in the first direction DR1 and a gate electrode GE branched off from the gate lines $G_1$ to $G_3$, is arranged on the first substrate 110. Although not illustrated in the drawings, the gate wiring may further include storage electrodes which are arranged to overlap the first to fourth pixel electrodes PE1, PE2, PE3, and PE4 and which also form an extra storage capacitor Cst.

The gate wiring may include an aluminum-based metal, such as aluminum Al or aluminum alloy, or a silver-based metal, such as silver Ag or silver alloy, a copper-based metal, such as copper Cu or copper alloy, or a molybdenum-based metal, such as molybdenum Mo or molybdenum alloy. Alternatively, the gate wiring may include any one of chrome Cr, tantalum Ta, and titanium Ti. Alternatively, the gate wiring may have a multi-film structure including at least two conductive films having different physical properties.

The gate insulating film 120 is disposed on a front surface of the first substrate 110 on which the gate wiring is arranged. The gate insulating film 120 may include silicon nitride SiNx, silicon oxide SiOx, or the like. Instead, the gate insulating film 120 may have a multi-film structure including at least two insulating layers having different physical properties.

A semiconductor layer SM is disposed on the gate insulating film 120. The semiconductor layer SM may be disposed to overlap the gate electrode GE located under the gate insulating film 120. The semiconductor layer SM may include amorphous silicon, polycrystalline silicon, or the like.

Data wiring, including the data lines $D_1$ to $D_{21}$, a source electrode SE branched off from data lines $D_1$ to $D_{21}$, and a drain electrode DE disposed to be spaced apart from the source electrode SE, is arranged on the semiconductor layer SM. The data wiring may include the same material as the above-described gate wiring.

The protective film 130 is disposed on the front surface of the first substrate 110 on which the semiconductor layer SM, the source electrode SE, and the drain electrode DE are formed. The protective film 130 may include an inorganic insulating material, such as silicon nitride SiNx, silicon oxide SiOx, or the like.

The first to fourth pixel electrodes PE1, PE2, PE3, and PE4 are located on the protective film 130. In this case, the first to fourth pixel electrodes PE1, PE2, PE3, and PE4 may be connected to the transistors TFT1, TFT2, TFT3, and TFT4 via the protective film 130, respectively.

The first to fourth pixel electrodes PE1, PE2, PE3, and PE4 may include a transparent conductive material, such as indium tin oxide (ITO), indium zinc oxide (IZO), or the like. In this case, ITO may be a polycrystalline or monocrystalline material, and IZO may be also a polycrystalline or monocrystalline material.

Since two data lines are arranged between the fourth pixel column PC4 and the first pixel column PC1, a spacing distance W1 between the fourth pixel column PC4 and the first pixel column PC1 may be larger than a spacing distance W2 between the first pixel column PC1 and the second pixel column PC2, between the second pixel column PC2 and the third pixel column PC3, and between the third pixel column PC3 and the fourth pixel column PC4.

In the same manner, a spacing distance W1 between the fourth pixel electrode PE4 and the first pixel electrode PE1 may be larger than a spacing distance W2 between the first pixel electrode PE1 and the second pixel electrode PE2, between the second pixel electrode PE2 and the third pixel electrode PE3, and between the third pixel electrode PE3 and the fourth pixel electrode PE4.

The counter substrate 200 may include a second substrate 210, a black matrix BM, color filters CF_R, CF_G, CF_B, and CF_W, a planarization layer 230, and a common electrode CE.

The second substrate 210 may include transparent glass or plastic, or the like.

The color filters CF_R, CF_G, CF_B, and CF_W may have stripe or island shapes which extend in the second direction DR2 on a plane.

As shown in FIG. 6, the color filters CF_R, CF_G, CF_B, and CF_W may be arranged on the second substrate 210. However, the arrangement of the color filters CF_R, CF_G, CF_B, and CF_W is not limited thereto, and the color filters CF_R, CF_G, CF_B, and CF_W may be arranged on the first substrate 110 and may thus form a color filter on array ("COA") structure in which the thin film transistors TFT and the color filters CF_R, CF_G, CF_B, and CF_W are arranged on the same substrate.

The red color filter CF_R may be disposed to correspond to the first pixel electrode PE1, the green color filter CF_G may be disposed to correspond to the second pixel electrode PE2, the blue color filter CF_B may be disposed to correspond to the third pixel electrode PE3, and the white color filter CF_W may be disposed to correspond to the fourth pixel electrode PE4. The white color filter CF_W may be an empty space, not a separate color filter.

The black matrix BM is located between the color filters CF_R, CF_G, CF_B, and CF_Ws and above the thin film transistors TFT. The black matrix BM may include a photosensitive or non-photosensitive organic material.

The planarization layer 230 is disposed on the color filters CF_R, CF_G, CF_B, and CF_W, and the black matrix BM. The planarization layer 230 makes a curved surface planar, or prevents impurities from being eluted.

The common electrode CE is disposed on the planarization layer 230. The common electrode CE may be a stave electrode made of a transparent conductive material, such as ITO, IZO, or the like. However, the shape of the common electrode CE is not limited thereto, and the common electrode CE may have a protrusion and depression shape and one or more slits in order to define a plurality of domains.

The liquid crystal layer 300 may have a negative dielectric constant, and may include vertically oriented liquid crystal molecules.

Figure 7:
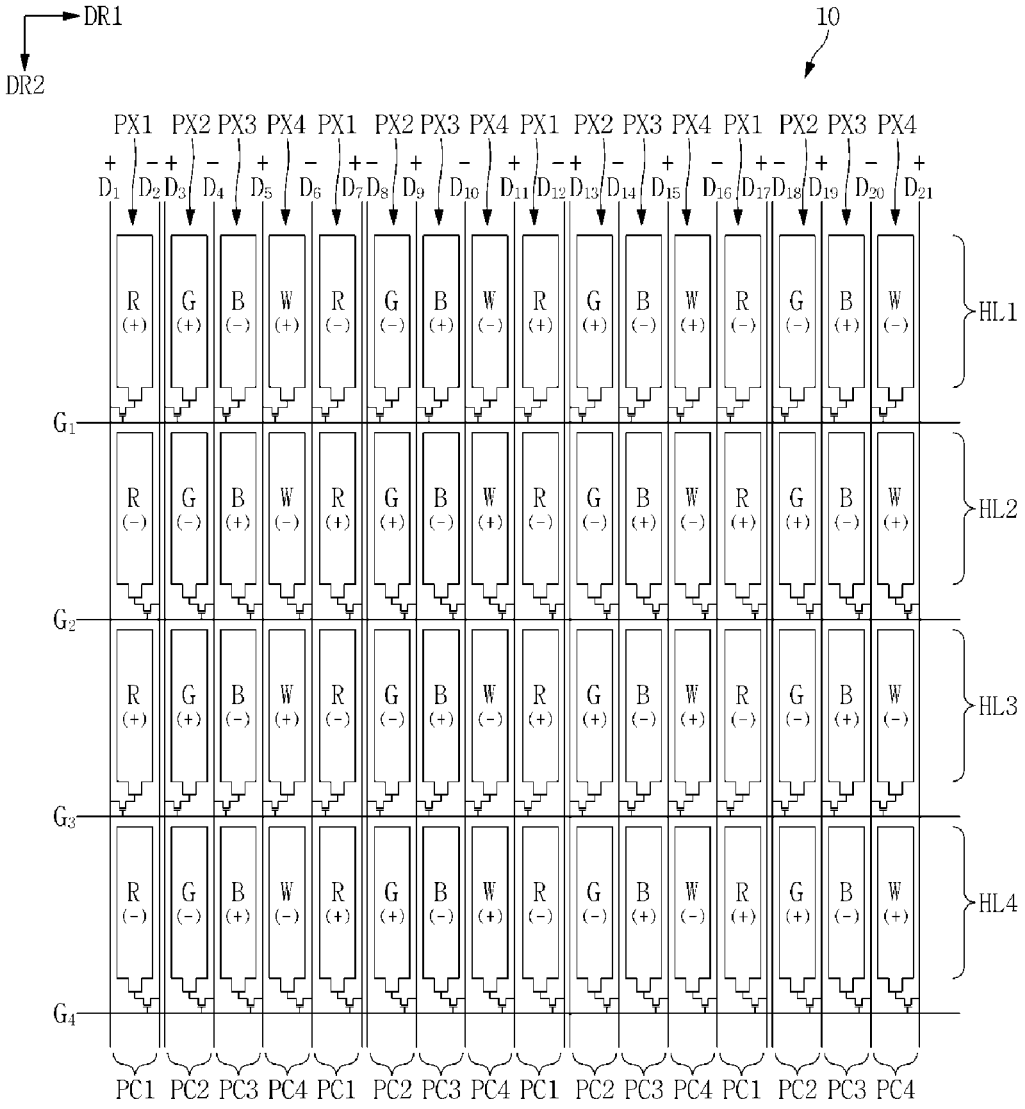
FIG. 7 is a plan view illustrating a display panel according to an embodiment.
Figure 8:
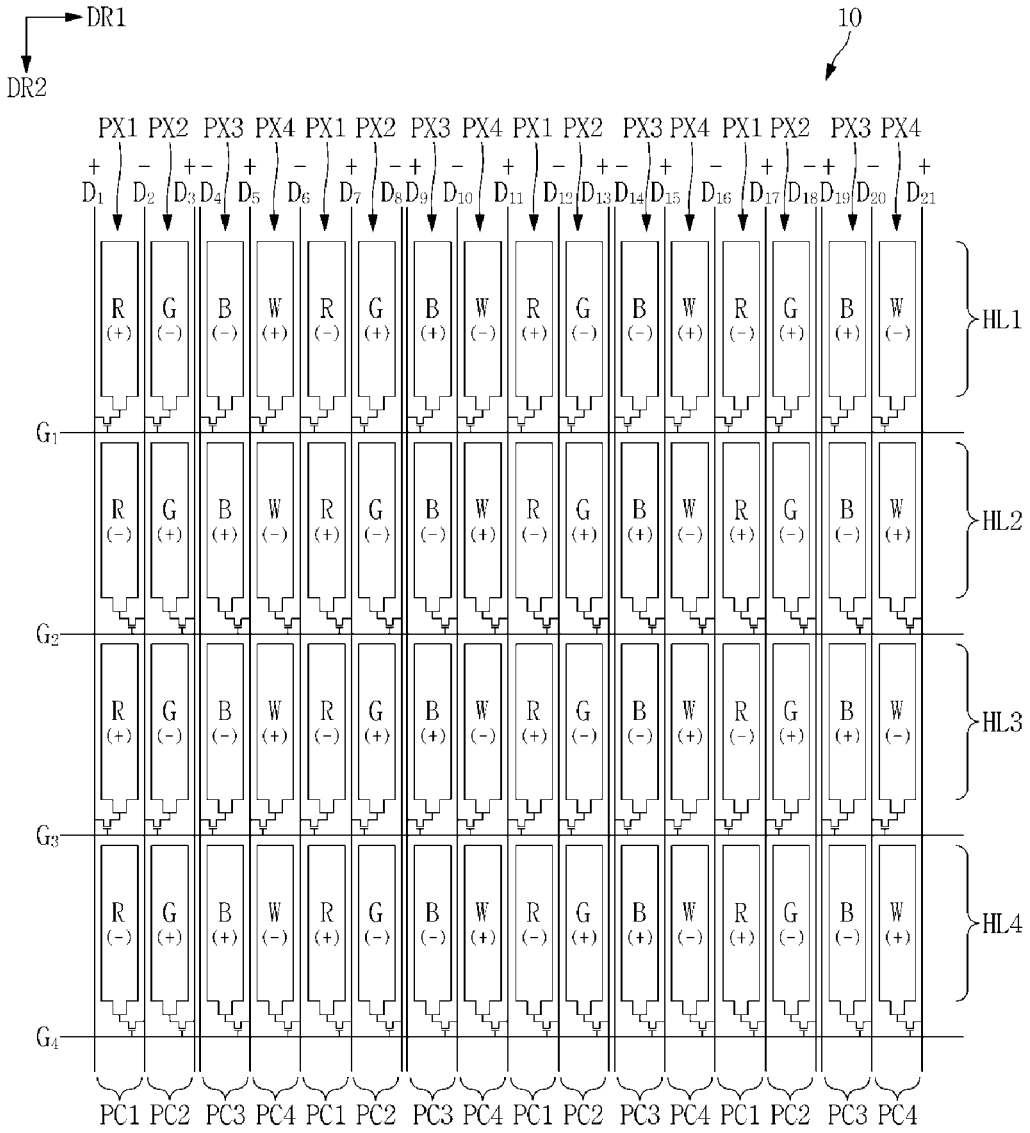
FIG. 8 is a plan view illustrating a display panel according to an embodiment.
Figure 9:
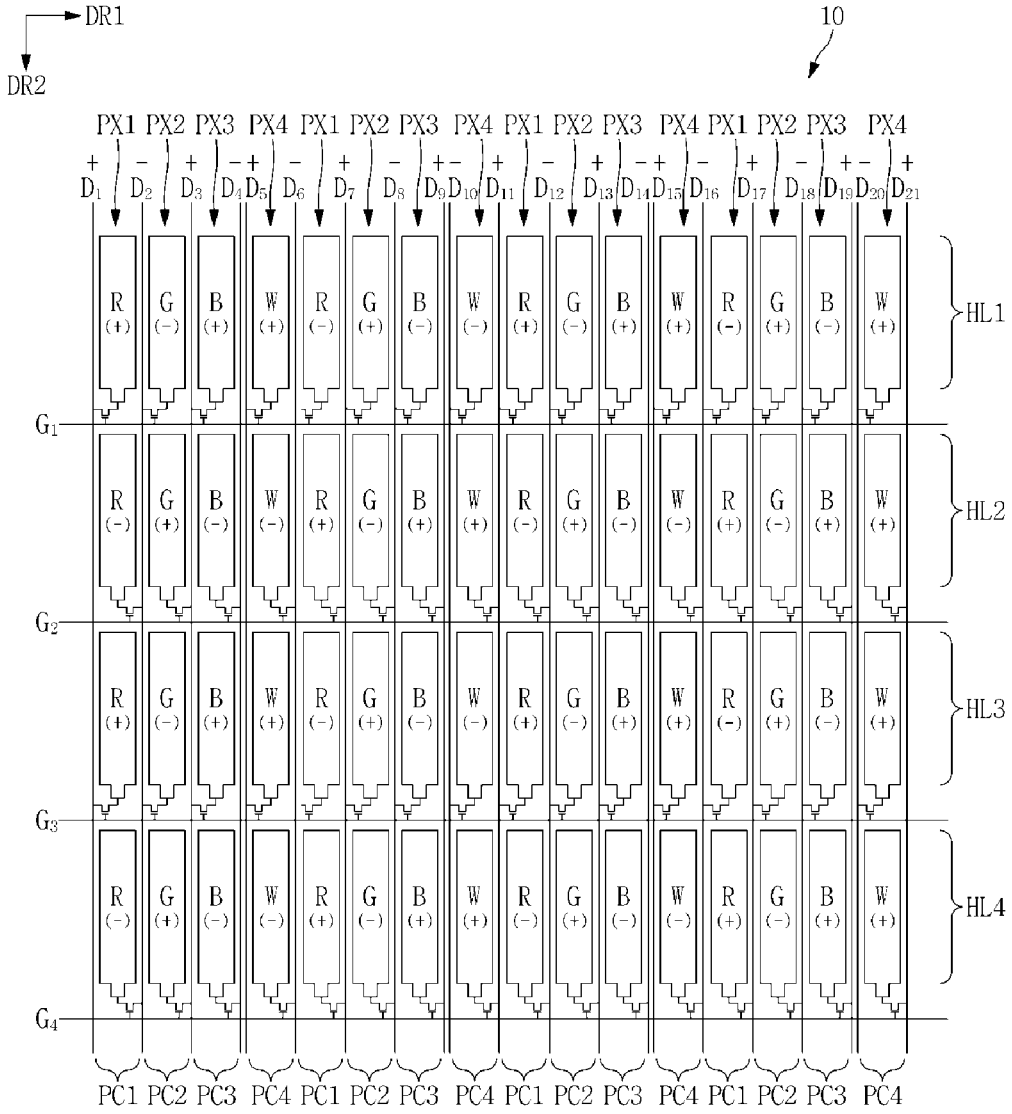
FIG. 9 is a plan view illustrating a display panel according to an embodiment.

FIG. 7 is a plan view illustrating a display panel according to a second embodiment, FIG. 8 is a plan view illustrating a display panel according to a third embodiment, and FIG. 9 is a plan view illustrating a display panel according to a fourth embodiment. In the following description of the second to fourth embodiments, descriptions identical to those of the first embodiment will be omitted.

Referring to FIG. 7, in the case of the second embodiment, second data lines $D_2$, $D_3$, $D_7$, $D_8$, $D_{12}$, $D_{13}$, $D_{17}$, $D_{18}$, . . . may be arranged between first and second pixel columns PC1 and PC2 arranged adjacent to each other, first data lines $D_1$, $D_4$ to $D_6$, $D_9$ to $D_{11}$, $D_{14}$ to $D_{16}$, and $D_{19}$ to $D_{21}$ may be arranged between second and third pixel columns PC2 and PC3, between third and fourth pixel columns PC3 and PC4, or between the fourth and first pixel columns PC4 and PC1.

Each of the second data lines $D_2$, $D_3$, $D_7$, $D_8$, $D_{12}$, $D_{13}$, $D_{17}$, $D_{18}$, . . . arranged between the first, and second pixel columns PC1, and PC2 may be connected to a pixel of a pixel column on its one side in every other row. For example, the data line $D_2$ may be connected to a pixel of the adjacent first pixel column PC1 in every other row, and the data line $D_3$ may be connected to a pixel of the adjacent second pixel column PC2 in every other row.

Referring to FIG. 8, in the case of the third embodiment, second data lines $D_3$, $D_4$, $D_8$, $D_9$, $D_{13}$, $D_{14}$, $D_{18}$, $D_{19}$, . . . may be arranged between second and third pixel columns PC2 and PC3 arranged adjacent to each other, and first data lines $D_1$, $D_2$, $D_5$ to $D_7$, $D_{10}$ to $D_{12}$, $D_{15}$ to $D_{17}$, $D_{20}$, and $D_{21}$ may be arranged between first and second pixel columns PC1 and PC2, between third and fourth pixel columns PC3 and PC4, or between the fourth and first pixel columns PC4 and PC1.

The second data lines $D_3$, $D_4$, $D_8$, $D_9$, $D_{13}$, $D_{14}$, $D_{18}$, $D_{19}$, . . . arranged between the second and third pixel columns PC2 and PC3 may be connected to a pixel of a pixel column on its one side in every other row. For example, the data line $D_3$ may be connected to a pixel of the adjacent second pixel column PC2 in every other row, and the data line $D_4$ may be connected to a pixel of the adjacent third pixel column PC3 in every other row.

Referring to FIG. 9, in the case of the fourth embodiment, second data lines $D_4$, $D_5$, $D_9$, $D_{10}$, $D_{14}$, $D_{15}$, $D_{19}$, $D_{20}$, . . . may be arranged between third and fourth pixel columns PC3 and PC4 arranged adjacent to each other, and first data lines $D_1$ to $D_3$, $D_6$ to $D_8$, $D_{11}$ to $D_{13}$, $D_{16}$ to $D_{18}$, and $D_{21}$ may be arranged between first and second pixel columns PC1 and PC2, between second and third pixel columns PC2 and PC3, or between the fourth and first pixel columns PC4 and PC1.

Each of the second data lines $D_4$, $D_5$, $D_9$, $D_{10}$, $D_{14}$, $D_{15}$, $D_{19}$, $D_{20}$, . . . arranged between the third and fourth pixel columns PC3 and PC4 may be connected to a pixel of a pixel column on its one side in every other row. For example, the data line $D_4$ may be connected to a pixel of the adjacent third pixel column PC3 in every other row, and the data line $D_5$ may be connected to alternately pixels of the adjacent fourth pixel column PC4 in every other row.

As described above, in the display panels according to the second to fourth embodiments, two data lines are arranged between specific two columns, and a pixel of each of the pixel columns in every other row are connected to one of the two data lines. Accordingly, a moving line stain phenomenon can be prevented from occurring in each of the pixel columns.

Figure 10:
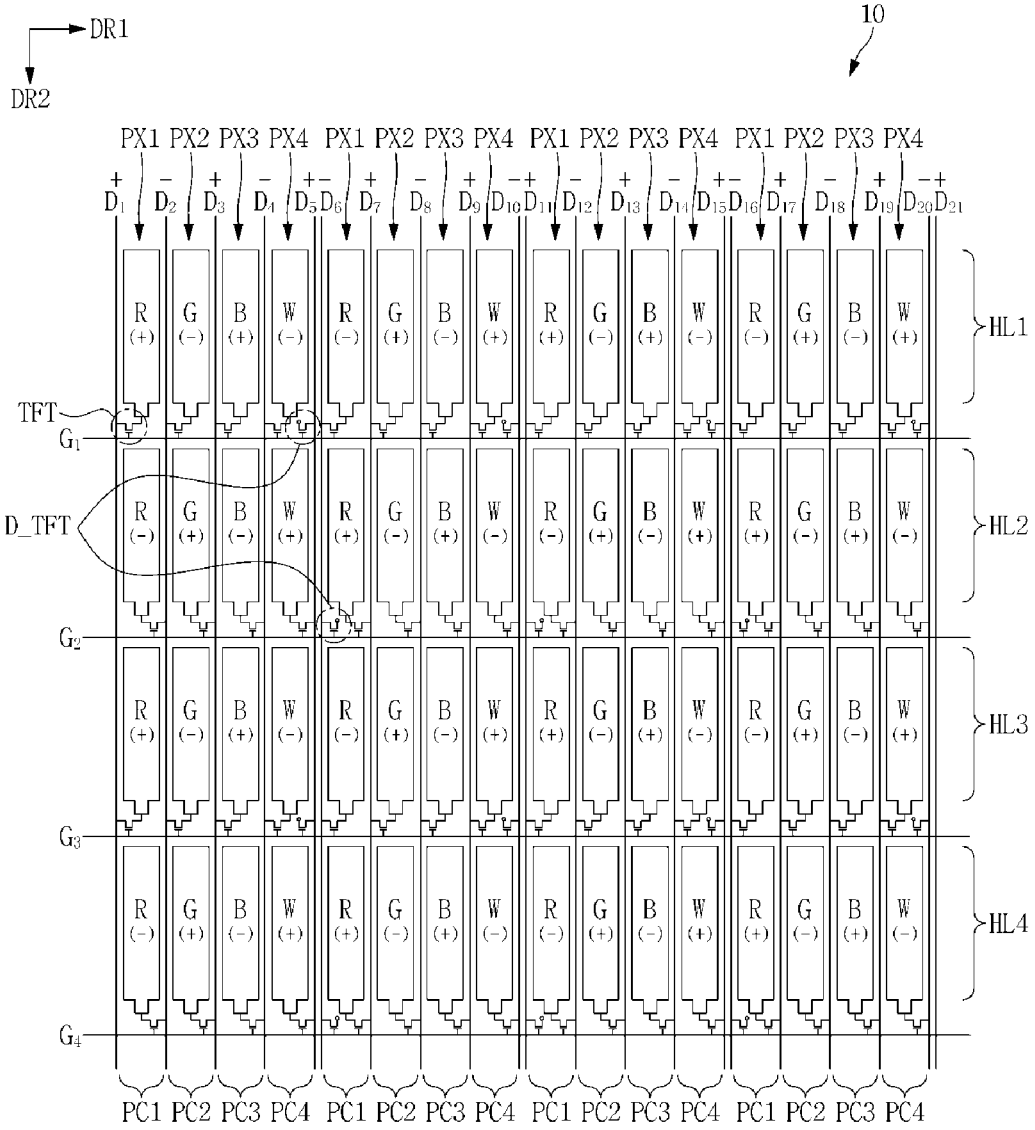
FIG. 10 is a plan view illustrating a display panel according to an embodiment.
Figure 11:
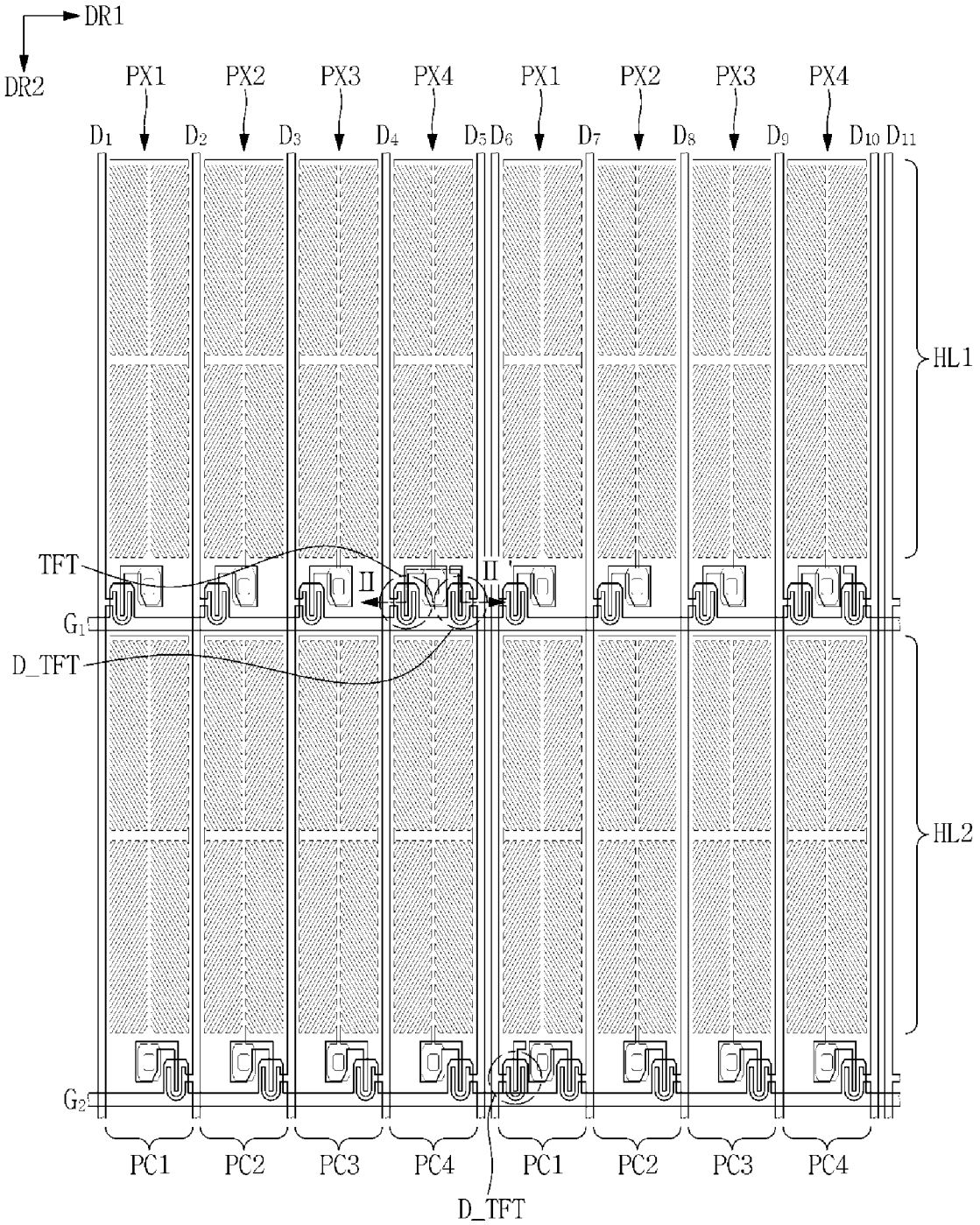
FIG. 11 is a plan view illustrating the display panel according to an embodiment.
Figure 12:
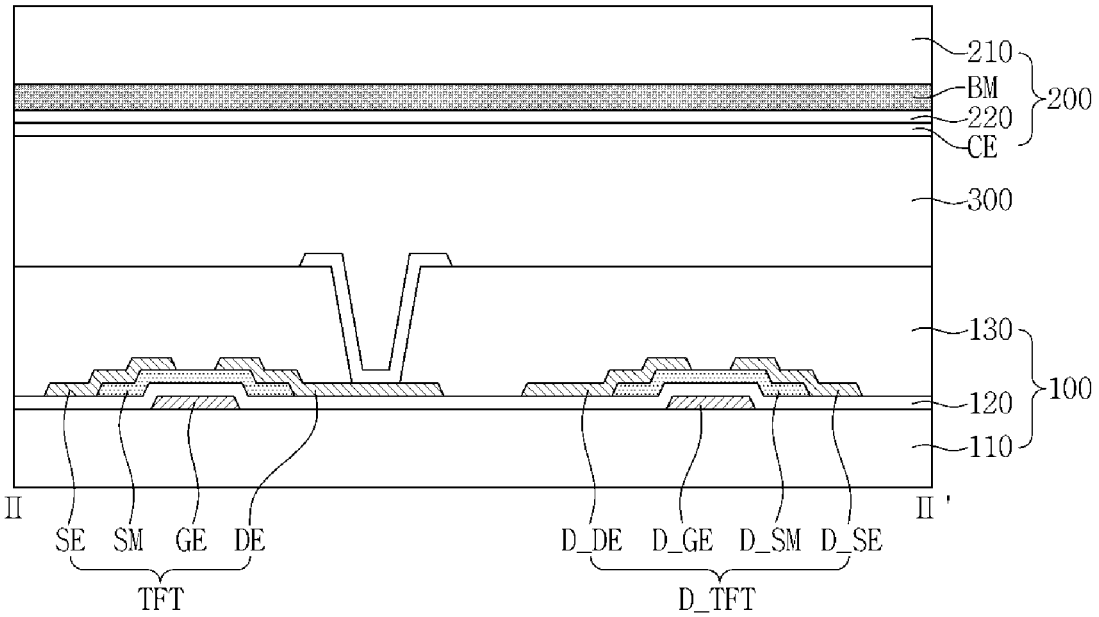
FIG. 12 is a sectional view taken along line II-II' of FIG. 11 according to an embodiment.

FIG. 10 is a plan view illustrating a display panel 10 according to a fifth embodiment, FIG. 11 is a plan view illustrating the display panel 10 according to the fifth embodiment, and FIG. 12 is a sectional view taken along line II-II' of FIG. 11. In the following description of the fifth embodiment, descriptions identical to those of the first to fourth embodiments will be omitted.

Referring to FIGS. 10 to 12, the display panel 10 according to the fifth embodiment may further include dummy thin film transistors D_TFT each connected to at least one of second data lines $D_5$, $D_6$, $D_{10}$, $D_{11}$, $D_{15}$, $D_{16}$, $D_{20}$, and $D_{21}$, . . . arranged between fourth and first pixel columns PC4 and PC1.

More specifically, the dummy thin film transistors D_TFT may be located between pixels of pixel columns arranged adjacent to the second data lines $D_5$, $D_6$, $D_{10}$, $D_{11}$, $D_{15}$, $D_{16}$, $D_{20}$, and $D_{21}$, . . . arranged between the fourth and first pixel columns PC4 and PC1. For example, some of the dummy thin film transistors D_TFT may be alternately located between pixels of the fourth pixel column PC4 arranged adjacent to the data line $D_5$, and some of the dummy thin film transistors D_TFT may be alternately located between pixels of the first pixel column PC1 arranged adjacent to the data line $D_6$.

In other words, each of the second data lines $D_5$, $D_6$, $D_{10}$, $D_{11}$, $D_{15}$, $D_{16}$, $D_{20}$, and $D_{21}$, . . . arranged between the fourth and first pixel columns PC4 and PC1 may be alternately connected to thin film transistors TFT and the dummy thin film transistors D_TFT.

Each of the dummy thin film transistors D_TFT may include a dummy gate electrode D_GE branched off from one of the gate lines $G_1$ to $G_4$, a dummy semiconductor layer D_SM disposed on the dummy gate electrode D_GE, and a dummy source electrode D_SE and a dummy drain electrode D_DE disposed to be spaced apart from each other on a dummy semiconductor layer D_SM. The dummy source electrode D_SE may be connected to one of the second data lines $D_5$, $D_6$, $D_{10}$, $D_{11}$, $D_{15}$, $D_{16}$, $D_{20}$, and $D_{21}$, . . . arranged between the fourth and first pixel columns PC4 and PC1. The dummy drain electrode D_DE is not connected to pixels of the fourth and first pixel columns PC4 and PC1.

The display panel 10 according to the fifth embodiment further includes the dummy thin film transistors D_TFT each connected to one of the second data lines $D_5$, $D_6$, $D_{10}$, $D_{11}$, $D_{15}$, $D_{16}$, $D_{20}$, and $D_{21}$, . . . arranged between the fourth and first pixel columns PC4 and PC1, thereby preventing an RC delay phenomenon which may occur in the second data lines $D_5$, $D_6$, $D_{10}$, $D_{11}$, $D_{15}$, $D_{16}$, $D_{20}$, and $D_{21}$, . . . arranged between the fourth and first pixel columns PC4 and PC1.

Figure 13:
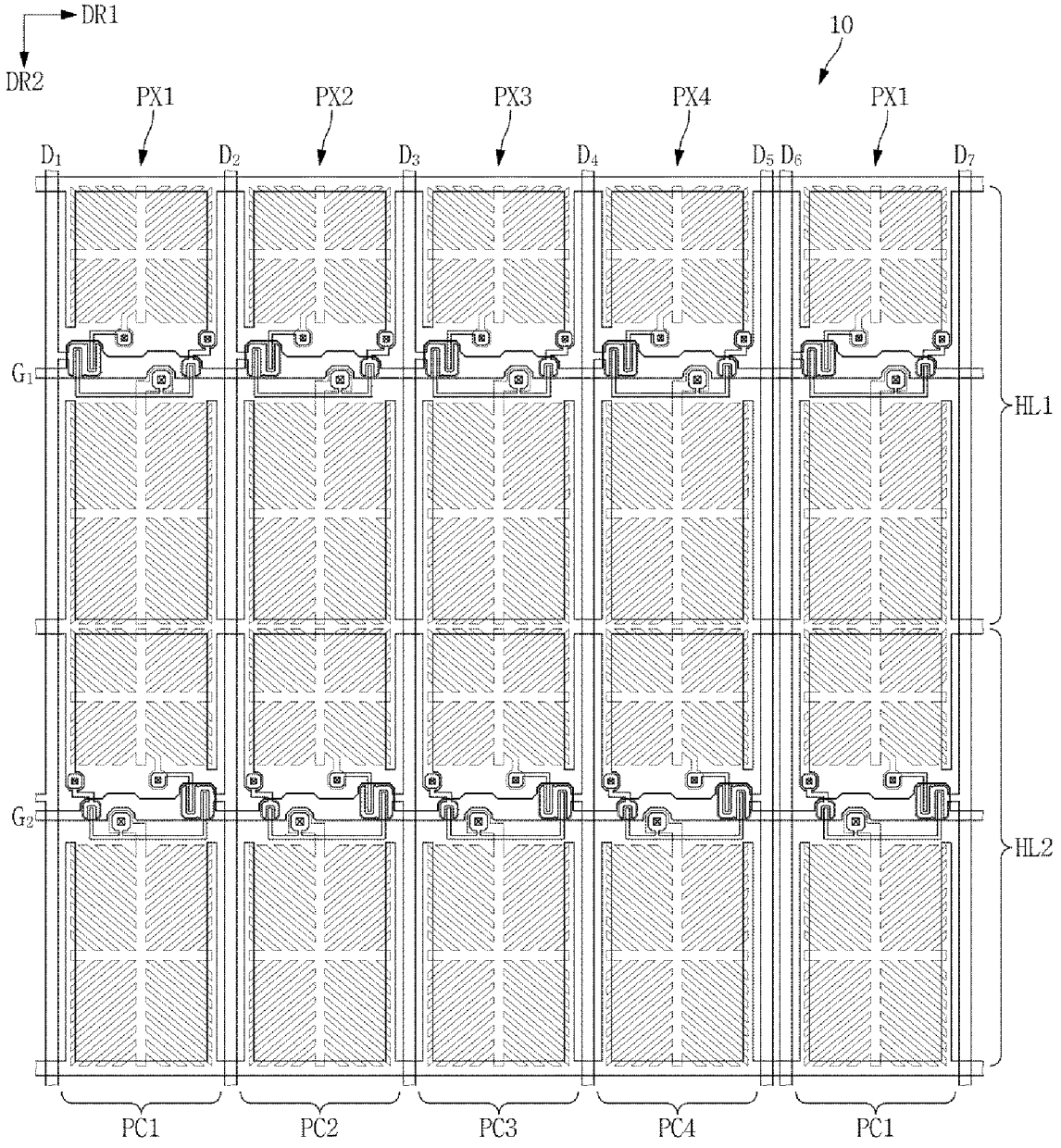
FIG. 13 is a plan view illustrating a display panel according to an embodiment.
Figure 14:
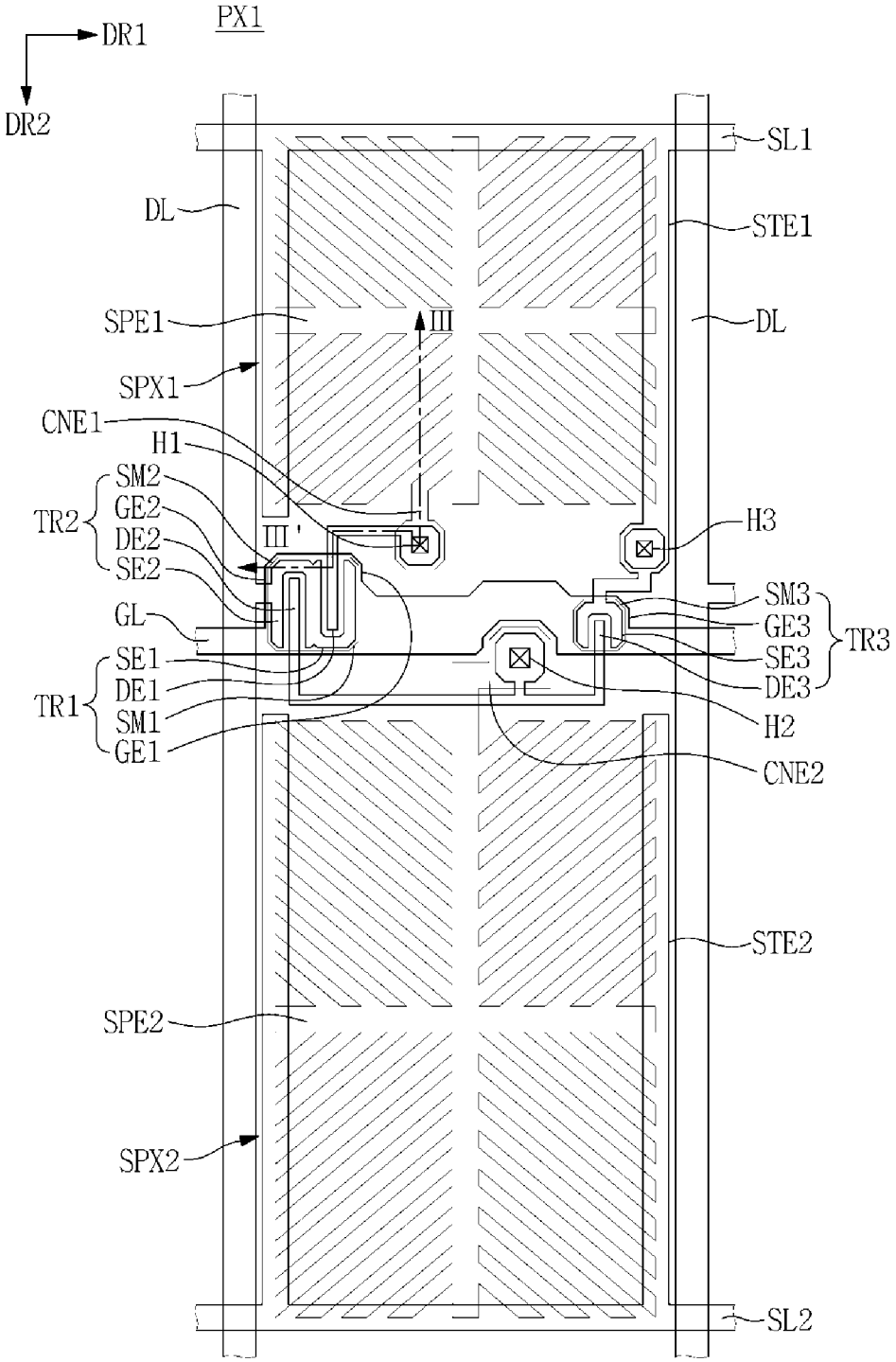
FIG. 14 is a plan view illustrating one pixel of FIG. 13 according to an embodiment.
Figure 15:
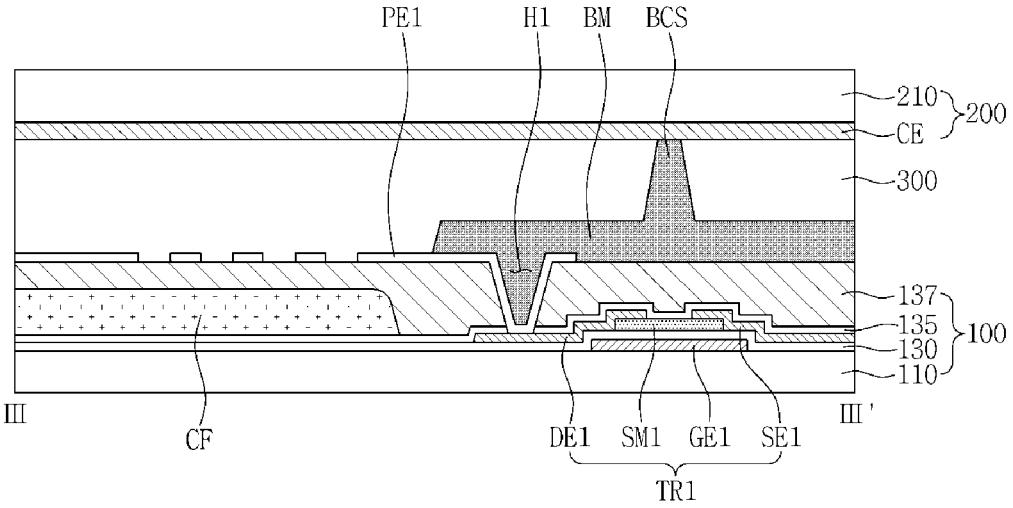
FIG. 15 is a sectional view taken along line III-III' of FIG. 14 according to an embodiment.

FIG. 13 is a plan view illustrating a display panel 10 according to a sixth embodiment, FIG. 14 is a plan view illustrating one pixel of FIG. 13, and FIG. 15 is a sectional view taken along line III-III' of FIG. 14. In the following description of the sixth embodiment, descriptions identical to those of the first to fifth embodiments will be omitted.

Referring to FIG. 13, the display panel 10 according to the sixth embodiment may include a first pixel PX1, a second pixel PX2, a third pixel PX3, and a fourth pixel PX4 which display different colors.

First to fourth pixels PX1 to PX4 may be repeatedly arranged in a first direction DR1, and first to fourth pixels PX1 to PX4 may be repeatedly arranged in a second direction DR2 which intersects the first direction DR1. Pluralities of first to fourth pixels PX1 to PX4 arranged in the second direction DR2 are referred to as "first to fourth pixel columns PC1 to PC4," respectively.

Two data lines $D_5$ and $D_6$ may be arranged between a fourth pixel column PC4 and a first pixel column PC1, and one data line may be arranged between each two of the remaining pixel columns.

Each of the two data lines $D_5$ and $D_6$ arranged between the fourth pixel column PC4 and the first pixel column PC1 may be connected to a pixel of its adjacent pixel column in every other row. For example, the data line $D_5$ may be connected to a pixel of the adjacent fourth pixel column PC4 in every other row, and the data line $D_6$ may be connected to a pixel of the adjacent first pixel column PC1 in every other row.

Furthermore, polarities of data voltages which are applied to each two of data lines $D_1$ to $D_7$ arranged adjacent to each other in the first direction DR1 may be opposite. Furthermore, polarities of data voltages which are applied to the data lines $D_1$ to $D_7$ may be inverted every frame period.

Referring to FIGS. 14 and 15, the first pixel PX1 according to the sixth embodiment includes a first sub-pixel SPX1 and a second sub-pixel SPX2.

The first sub-pixel SPX1 includes a first thin film transistor TR1, a first sub-pixel electrode SPE1, and a first storage electrode STE1. The second sub-pixel SPX2 includes a second thin film transistor TR2, a second sub-pixel electrode SPE2, a second storage electrode STE2, and a third thin film transistor TR3.

The first sub-pixel SPX1 may be referred to as a "high pixel," and the second sub-pixel SPX2 may be referred as a "low pixel."

The first thin film transistor TR1 of the first sub-pixel SPX1 includes: a first gate electrode GE1 branched off from a gate line GL; a first semiconductor layer SM1 disposed to overlap the first gate electrode GE1; a first source electrode SE1 branched off from a data line DL, and disposed to overlap the first semiconductor layer SM1; and a first drain electrode DE1 disposed to be spaced apart from the first source electrode SE1 and to overlap the first semiconductor layer SM1. The first drain electrode DE1 is connected to the first sub-pixel electrode SPE1. More specifically, the first drain electrode DE1 extends to the first sub-pixel electrode SPE1, and is electrically connected to a first connection electrode CNE1, branched off from the first sub-pixel electrode SPE1, via a first contact hole H1.

The first storage electrode STE1 is connected to a first storage line SL1. The first sub-pixel electrode SPE1 partially overlaps the first storage line SL1 and the first storage electrode STE1, and forms a first storage capacitor. The first storage electrode STE1 receives a storage voltage.

The second thin film transistor TR2 of the second sub-pixel SPX2 includes: a second gate electrode GE2 branched off from the gate line GL; a second semiconductor layer SM2 disposed to overlap the second gate electrode GE2; a second source electrode SE2 branched off from a data line DL, and disposed to overlap the second semiconductor layer SM2; and a second drain electrode DE2 disposed to be spaced apart from the second source electrode SE2 and to overlap the second semiconductor layer SM2. The second drain electrode DE2 is connected to the second sub-pixel electrode SPE2. More specifically, the second drain electrode DE2 extends to the second sub-pixel electrode SPE2, and is electrically connected to a second connection electrode CNE2, branched off from the second sub-pixel electrode SPE2, via a second contact hole H2.

The third thin film transistor TR3 of the second sub-pixel SPX2 includes: a third gate electrode GE3 branched off from the gate line GL; a third source electrode SE3 electrically connected to the first storage electrode STE1 via a third contact hole H3; a third drain electrode DE3 extending from the second drain electrode DE2; and a third semiconductor layer SM3. The third source electrode SE3 and the first storage electrode STE1 are electrically connected to each other via the third contact hole H3. Furthermore, the third drain electrode DE3 is electrically connected to the second sub-pixel electrode SPE2 via the second contact hole H2.

The second storage electrode STE2 is connected to the second storage line SL2. The second sub-pixel electrode SPE2 partially overlaps the second storage line SL2 and the second storage electrode STE2, and forms a second storage capacitor. The second storage electrode STE2 receives a storage voltage.

The gate line GL, the first, second and third gate electrodes GE1, GE2, and GE3 branched off from the gate line GL, the first storage line SL1, the first storage electrode STE1, the second storage line SL2, and the second storage electrode STE2 are arranged on the first substrate 110.

A gate insulating film 130 which covers the gate line GL, the first, second, and third gate electrodes GE1, GE2, and GE3, the first, and second storage lines SL1, and SL2, and the first, and second storage electrodes STE1, and STE2 is disposed on the first substrate 110.

The first, second, and third semiconductor layers SM1, SM2, and SM3 are arranged on the gate insulating film 130. The first, second, and third semiconductor layers SM1, SM2, and SM3 may include amorphous silicon, or may be each made of an oxide semiconductor including at least one of gallium Ga, indium In, tin Sn, and zinc Zn. For example, the oxide semiconductor may include at least one selected from the group consisting of zinc oxide (ZnO), zinc-tin oxide (ZTO), zinc-indium oxide (ZIO), indium oxide (InO), titanium oxide (TiO), indium-gallium-zinc oxide (IGZO), and indium-zinc-tin oxide (IZTO).

The data line DL extends in a vertical direction, and is arranged on the gate insulating film 130. The first, second, and third source electrodes SE1, SE2, and SE3 are arranged to overlap the first, second, and third semiconductor layers SM1, SM2, and SM3, and the first, second and third drain electrodes DE1, DE2, and DE3 are arranged, thereby forming the first, second, and third thin film transistors TR1, TR2, and TR3.

The third source electrode SE3 of the third thin film transistor TR3 is electrically connected to the first storage electrode STE1 via the third contact hole H3 which is formed to pass through the gate insulating film 130.

An interlayer insulating film 135 is disposed to cover the data line DL, and the first, second, and third thin film transistors TR1, TR2, and TR3. The interlayer insulating film 135 covers exposed upper portions of the first, second, and third semiconductor layers SM1, SM2, and SM3. The Interlayer insulating film 135 may have a single film or multi-film structure, including, for example, silicon oxide, silicon nitride, a photosensitivity organic material, or a silicon-based low-dielectric constant insulating material.

A color filter CF is disposed on the interlayer insulating film 135.

The color filter CF is disposed to overlap the first, and second sub-pixel electrodes SPE1, and SPE2, and provides a color to light which passes through a pixel. The color filter may be any one of a red color filter, a green color filter, a blue color filter, and a white color filter.

The color filter CF may be disposed on the first, and second sub-pixel electrodes SPE1, and SPE2 in an island form, or may be disposed in a form of extending in the second direction DR2.

A protective layer 137 is disposed on the interlayer insulating film 135 and the color filter CF. The protective layer 137 may have a single film or multi-film structure, including silicon oxide, silicon nitride, a photosensitivity organic material, or a silicon-based low-dielectric constant insulating material.

The protective layer 137 serves to make the tops of the first, second, and third thin film transistors TR1, TR2, and TR3 and the color filter CF planar. Accordingly, the protective layer 137 is also referred to as a "planarization film."

The first contact hole H1 exposing part of the first drain electrode DE1, and the second contact hole H2 exposing part of the second drain electrode DE2 are formed by removing parts of the interlayer insulating film 135 and the protective layer 137.

The first sub-pixel electrode SPE1, and the second sub-pixel electrode SPE2 are arranged on the protective layer 137. The first sub-pixel electrode SPE1 is electrically connected to the first drain electrode DE1 via the first contact hole H1, and the second sub-pixel electrode SPE2 is electrically connected to the second drain electrode DE2 via the second contact hole H2.

Each of the first, and second sub-pixel electrodes SPE1, and SPE2 includes a cross-shaped stem portion, and a plurality of branch portions slantingly extending from the cross-shaped stem portion in different directions. The first, and second sub-pixel electrodes SPE1, and SPE2 may include a transparent conductive material. For example, the first, and second sub-pixel electrodes PE1, and PE2 may include a transparent conductive material, such as ITO, IZO, ITZO, AZO, or the like.

A black matrix BM extending in a first direction D1 is disposed on the protective layer 137. Furthermore, a black column spacer BCS may be disposed on the black matrix BM.

Although not shown in the drawings, a lower alignment layer may be disposed on the first, and second sub-pixel electrodes SPE1, and SPE2. The lower alignment layer may be a vertical alignment layer, and may include a photoreactive material.

The second substrate 210 is an insulating substrate made of a transparent glass or plastic, or the like.

The common electrode CE is disposed on the second substrate 210. The common electrode CE may include transparent conductive oxide, such as ITO, IZO, AZO, or the like.

Although not shown in the drawings, an upper alignment layer may be disposed on the common electrode CE. The upper alignment layer may include the same material as the lower alignment layer.

A liquid crystal layer 300 is disposed in a spacing space between the first substrate 110, and the second substrate 210.

Figure 16:
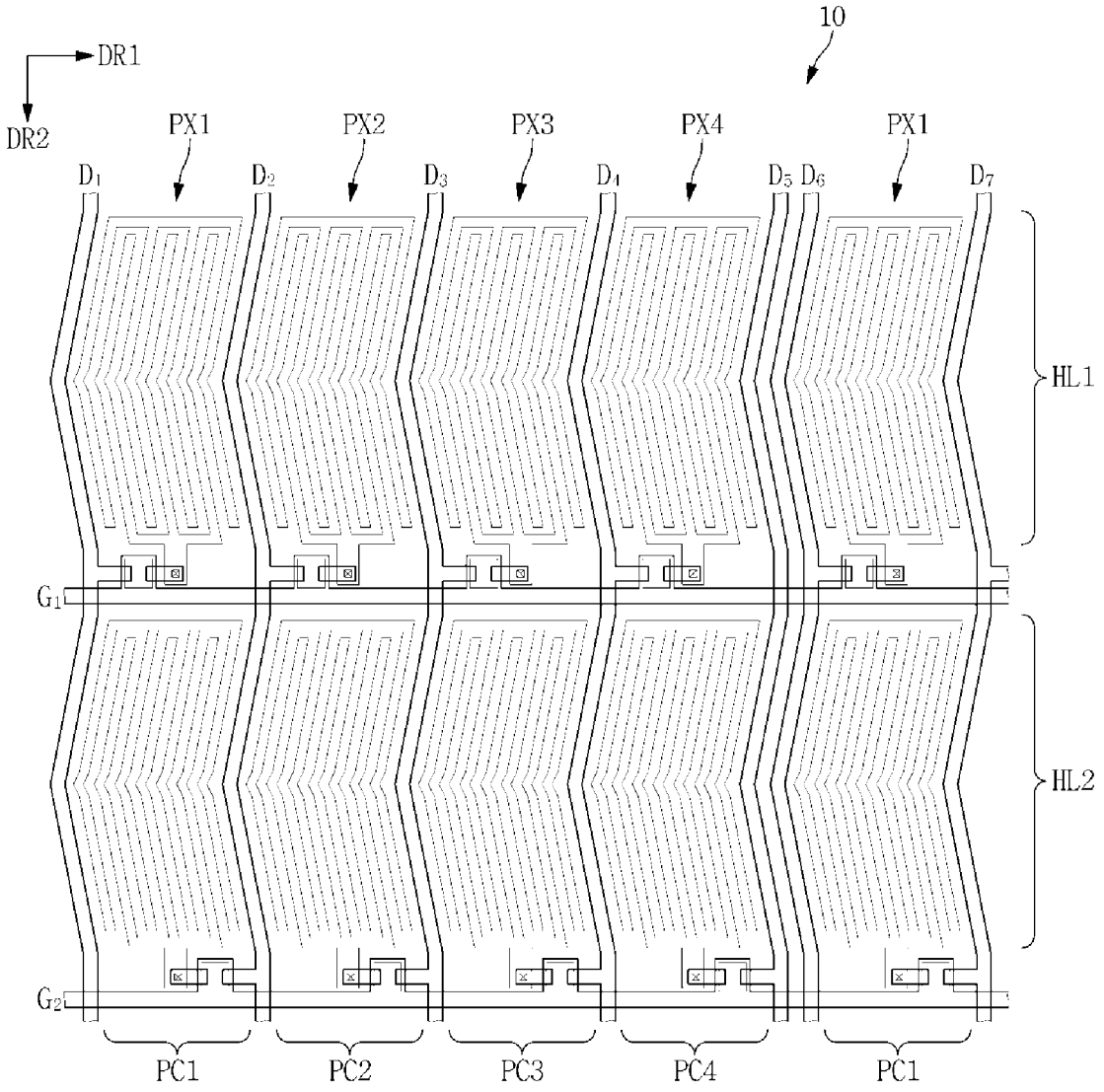
FIG. 16 is a plan view illustrating a display panel according to an embodiment.
Figure 17:
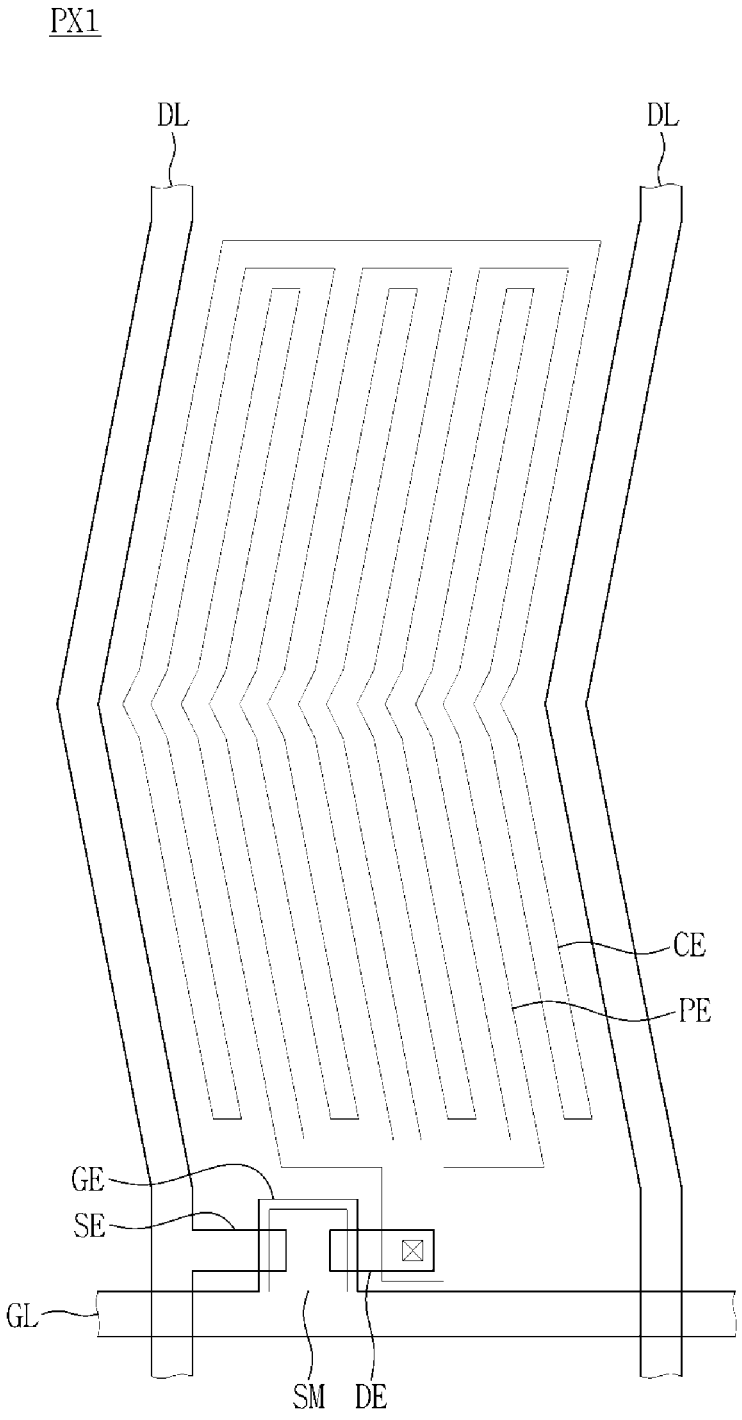
FIG. 17 is a plan view illustrating one pixel of FIG. 16 according to an embodiment.

FIG. 16 is a plan view illustrating a display panel 10 according to a seventh embodiment, and FIG. 17 is a plan view illustrating one pixel of FIG. 16. In the following description of the seventh embodiment, descriptions identical to those of the first to sixth embodiments will be omitted.

Referring to FIG. 16, the display panel 10 according to the seventh embodiment may include a first pixel PX1, a second pixel PX2, a third pixel PX3, and a fourth pixel PX4 which display different colors.

First to fourth pixels PX1 to PX4 may be repeatedly arranged in a first direction DR1, and first to fourth pixels PX1 to PX4 may be repeatedly arranged in a second direction DR2 which intersects the first direction DR1. Pluralities of first to fourth pixels PX1 to PX4 arranged in the second direction DR2 are referred to as "first to fourth pixel columns PC1 to PC4," respectively.

Two data lines $D_5$ and $D_6$ may be arranged between a fourth pixel column PC4 and a first pixel column PC1, and one data line may be arranged between each two of the remaining pixel columns.

Each of the two data lines $D_5$ and $D_6$ arranged between the fourth pixel column PC4 and the first pixel column PC1 may be connected to a pixel of its adjacent pixel column in every other row. For example, the data line $D_5$ may be connected to a pixel of an adjacent fourth pixel column PC4 in every other row, and the data line $D_6$ may be connected to a pixel of an adjacent first pixel column PC1 in every other row.

Furthermore, polarities of data voltages which are applied to each two of data lines $D_1$ to $D_7$ arranged adjacent to each other in the first direction DR1 may be opposite. Furthermore, polarities of data voltages which are applied to the data lines $D_1$ to $D_7$ may be inverted every frame period.

Referring to FIG. 17, the first pixel PX1 according to the seventh embodiment may include a gate line GL, a gate electrode GE, a semiconductor layer SM, a data line DL, a source electrode SE, a drain electrode DE, a pixel electrode PE, and a common electrode CE.

The pixel electrode PE and the common electrode CE may be arranged on the same layer or different layers. The pixel electrode PE generates a horizontal electric field along with the common electrode CE.

The pixel electrode PE and the common electrode CE may be formed to intersect each other in rectilinear shapes on a plane. Alternatively, as shown in FIG. 17, each of the pixel electrode PE and the common electrode CE may be formed in a shape of being bent one or more times on a plane, and may thus form multiple domains. The data line DL may have the same bent shape as the pixel electrode PE and the common electrode CE.

As the pixel electrode PE and the common electrode CE have multiple domains, a wide viewing angle may be implemented.

As described above, a display device according to one or more embodiments may prevent a moving line stain phenomenon, which may occur in a specific pixel column in an LCD device including white pixels.

Example embodiments have been described for purposes of illustration. Various modifications may be made to the described embodiments without departing from the scope and spirit defined by the claims. Various features of the described embodiments and other embodiments can be mixed and matched to produce further embodiments.

What is claimed is:

1. A liquid crystal display device comprising:

a plurality of gate lines extending in a first direction;

a plurality of data lines extending in a second direction which is different from the first direction; and a plurality of pixels electrically connected to the gate lines and the data lines, wherein the pixels are arranged in pixel columns and pixel rows, wherein each pixel column of the pixel columns is located between immediately adjacent two of the data lines, wherein consecutively arranged four of the pixel columns are configured to display four different colors, respectively, wherein the data lines comprise first-type data lines and second-type data lines, wherein exactly one pixel column of the pixel columns is positioned between every immediately neighboring two of the first-type data lines, wherein no pixel column is positioned between any immediately neighboring two of the second-type data lines, wherein each of the first-type data lines is electrically connected to a pixel of a first immediately adjacent pixel column in every odd-numbered pixel row and is electrically connected to a pixel of a second immediately adjacent pixel column in every even-numbered pixel row, wherein each of the second-type data lines is electrically connected to a pixel of exactly one immediately adjacent pixel column in every other pixel row, wherein each immediately neighboring pair of the second-type data lines is arranged between a first-color pixel column and a second-color pixel column that immediately neighbor each other and are configured to respectively display a first color and a second color different from each other, and wherein a black matrix is disposed above the first-type data lines and the second-type data lines and a width of the black matrix above the second-type data lines is wider than a width of the black matrix above the first-type data lines.

2. The liquid crystal display device of claim 1, wherein a distance between an immediately neighboring pair of a first-color pixel column and a second-color pixel column is larger than each of a distance between an immediately neighboring pair of a second-color pixel column and third-color pixel column, a distance between an immediately neighboring pair of a third-color pixel column and a fourth-color pixel column, and a distance between an immediately neighboring pair of a fourth-color pixel column and a first-color pixel column.

* * * * *